United States Patent [19]

Gottwaldt

[11] Patent Number: 4,495,853

[45] Date of Patent: Jan. 29, 1985

[54] FIXED ELEVATION AUTOMATIC LOADING SYSTEM FOR FIXED AMMUNITION

[75] Inventor: Paul R. Gottwaldt, Coon Rapids, Minn.

[73] Assignee: FMC Corporation, Chicago, Ill.

[21] Appl. No.: 397,722

[22] Filed: Jul. 13, 1982

[51] Int. Cl.[3] ..... F41H 7/06

[52] U.S. Cl. ..... 89/46; 89/34

[58] Field of Search ..... 89/45, 46, 47

[56] References Cited

U.S. PATENT DOCUMENTS

| | | | |
|---|---|---|---|
| 1,602,568 | 10/1926 | Conlon | 89/47 |
| 3,122,967 | 3/1964 | Johnson et al. | 89/46 |
| 3,218,930 | 11/1965 | Girouard | 89/45 |
| 3,331,279 | 7/1967 | Aldrin et al. | 89/1.802 |
| 3,625,107 | 12/1971 | Smith et al. | 89/1.8 |
| 3,625,108 | 12/1971 | Smith et al. | 89/1.804 |
| 3,625,109 | 12/1971 | Cornelison | 89/1.807 |
| 3,625,110 | 12/1971 | Cornelison et al. | 89/1.807 |
| 3,988,962 | 11/1976 | Elwin | 89/46 |
| 3,994,202 | 9/1976 | Tidstrom | 89/36 L |
| 4,183,281 | 1/1980 | Hultgren et al. | 89/47 |

FOREIGN PATENT DOCUMENTS

| | | | |
|---|---|---|---|
| 1172991 | 6/1964 | Fed. Rep. of Germany . | |
| 2027586 | 12/1970 | Fed. Rep. of Germany . | |
| 1578093 | 5/1971 | Fed. Rep. of Germany . | |
| 2501424 | 7/1975 | Fed. Rep. of Germany | 89/47 |
| 3042615 | 5/1982 | Fed. Rep. of Germany | 89/47 |
| 2428814 | 1/1980 | France . | |
| 2444247 | 7/1980 | France . | |
| 11461 of 1896 | | United Kingdom | 89/45 |
| 1251176 | 10/1971 | United Kingdom . | |
| 1523432 | 8/1978 | United Kingdom | 89/46 |
| 2087052 | 5/1982 | United Kingdom . | |

OTHER PUBLICATIONS

E1601a, 3/1/77, FMC Program For Upgrading 40-mm 60-Caliber Guns, FMC Corporation, Northern Ordnance Div.

*Primary Examiner*—Stephen C. Bentley

*Attorney, Agent, or Firm*—H. M. Stanley; R. B. Megley

[57] ABSTRACT

A turret is movable in azimuth within a turret support structure and a large caliber cannon is movable in elevation within the turret. An automatic loading mechanism is contained within the turret operating to move fixed ammunition rounds between a turret mounted magazine and the cannon breech. The magazine in one embodiment includes a rotating carousel and a number of rotatable drums mounted thereon. The drums have storage cells for ammunition rounds. A transfer mechanism operates to move the rounds between a transfer position to which each of the cells may be indexed and a loading position aligned with the breech when the cannon is positioned substantially at zero elevation. The transfer mechanism performs magazine load and misfire transfer functions as well. A guide tube is provided, movable between a position aligned with the breech and an out-of-the-way position, for directing spent round cases from the turret upon being ejected from the breech after firing.

11 Claims, 20 Drawing Figures

FIXED ELEVATION AUTOMATIC LOADING SYSTEM FOR FIXED AMMUNITION

BACKGROUND OF THE INVENTION

1. Field of the Invention

This invention relates to an automatic ammunition loading system for a large caliber cannon, and more particularly to such system which delivers a series of fixed ammunition rounds from a system magazine to the breech of the cannon.

2. Description of the Prior Art

An ammunition round generally consists of a projectile, a propelling charge and a primer. Large caliber ammunition usually falls into two categories. Separate ammunition is the term applied to ammunition in which all three parts are separate and are brought together only at the breech of a cannon. Semi-fixed ammunition is the term applied to ammunition wherein the projectile is separate but the propellant and the primer are fixed together. Fixed ammunition is a type wherein all three of the component parts of the ammunition are fixed together as a unit. Some large caliber ammunition is of the fixed type although the most widely known type of such ammunition is that which is exemplified by a rifle or a machine gun shell.

Ammunition loading systems are well known for large caliber cannons mounted on a gun carriage. The barrel of such a cannon is generally controllable in elevation on the carriage and the carriage is in turn controllable in azimuth position. Such a cannon is seen in the disclosure of the Girouard et al U.S. Pat. No. 3,218,930. This disclosure relates to an ammunition handling system wherein magazines provide both a projectile and a propellant charge to a hoist which lifts the projectile and charge together upwardly to a carrier. The carrier receives the projectile and the charge together and rotates to the azimuth position of the gun carriage. When the carrier reaches the gun azimuth position, the projectile and charge, referred to as a round hereinafter, is received from the carrier by a cradle on the gun carriage. The cradle is elevated about the gun support trunnions to a position such that the round is adjacent the rear of the gun and the cradle axis is parallel to the axis of the gun bore. The round is transferred from the cradle to a transfer tray and the tray is then swung downwardly to a position which is coaxial with the bore of the gun. The round is then rammed into the breech to complete the transfer from the magazine to the gun breech.

U.S. Pat. No. 3,122,967 issued to Johnson et al discloses a system for delivering semi-fixed rounds of ammunition from a magazine to the breech of a large caliber gun movable in azimuth and elevation. The magazine includes drum type holders for projectiles and propellant charges which deliver a projectile and a propellant charge together to a lower hoist. The lower hoist lifts the round to a movable carrier. The carrier is caused to rotate about the gun azimuth axis and to deliver the round to an upper hoist. The upper hoist rotates with the gun carriage and delivers the round to a swinging cradle which carries the round to a position where it is delivered to a transfer tray. The tray moves the round into axial alignment with the bore of the gun and a ram is utilized to insert the round into the gun breech.

An automated large caliber ammunition handling system is disclosed in co-pending patent application Ser. No. 443,341 filed Nov. 19, 1982 and assigned to the Assignees of the invention disclosed herein. A cannon is mounted on a gun carriage and is free to move in elevation on the carriage about an elevation axis. The carriage is controlled in azimuth for gun pointing. Storage drums for holding a plurality of projectiles and charges are mounted on the carriage. A projectile tray and a propellant charge tray are positioned to receive the projectiles and their propellant charges from the respective storage drums. The trays are pivotally mounted on independent cradle arms so that they may be rotated on the arms between a receiving position and a gun loading position. The cradle arms are pivotally mounted on the gun carriage so that they may be moved in elevation between the receiving position and the gun loading position in alignment with the breech. A control is provided which actuates the mechanism in sequence to transfer the projectiles and charges from the storage drums to the trays and from the trays to the breech. The control monitors the positions of the system mechanical components and insures an appropriate operating sequence so that a series of ammunition rounds are delivered from the drums to the breech.

SUMMARY OF THE INVENTION

The invention disclosed herein relates to an automatic loading system for fixed ammunition rounds for a large caliber gun which is movable in elevation and which is carried in a gun support structure. A magazine is disposed within the gun support structure and is mounted therein for rotation relative thereto. The magazine has a plurality of ammunition round storage cells. Means is provided for indexing the magazine rotationally so that predetermined ones of the storage cells are brought into a transfer position. A carriage is mounted for translational movement on the gun support structure. A transfer tray is mounted for rotational movement on the carriage. Means is provided for urging ammunition rounds into and out of the transfer tray. Further means is provided for moving the transfer tray between a position aligned with the transfer position and a fixed or predetermined elevation load/unload position aligned with the gun breech at zero gun elevation. Structure is provided for receiving spent ammunition cases from the breech after firing and for discharging the spent ammunition cases to an out-of-the-way position. Means is included for controlling actuation of the means for indexing, means for moving ammunition rounds into and out of the transfer tray, means for moving the transfer tray between zero elevation and transfer positions and means for receiving spent ammunition cases in appropriate sequences to operate the system in any one of several selected modes.

BRIEF DESCRIPTION OF THE DRAWINGS

FIG. 9 is a block diagram of the control system of one embodiment of the automatic loading system.

DESCRIPTION OF THE PREFERRED EMBODIMENTS

Figure 1:
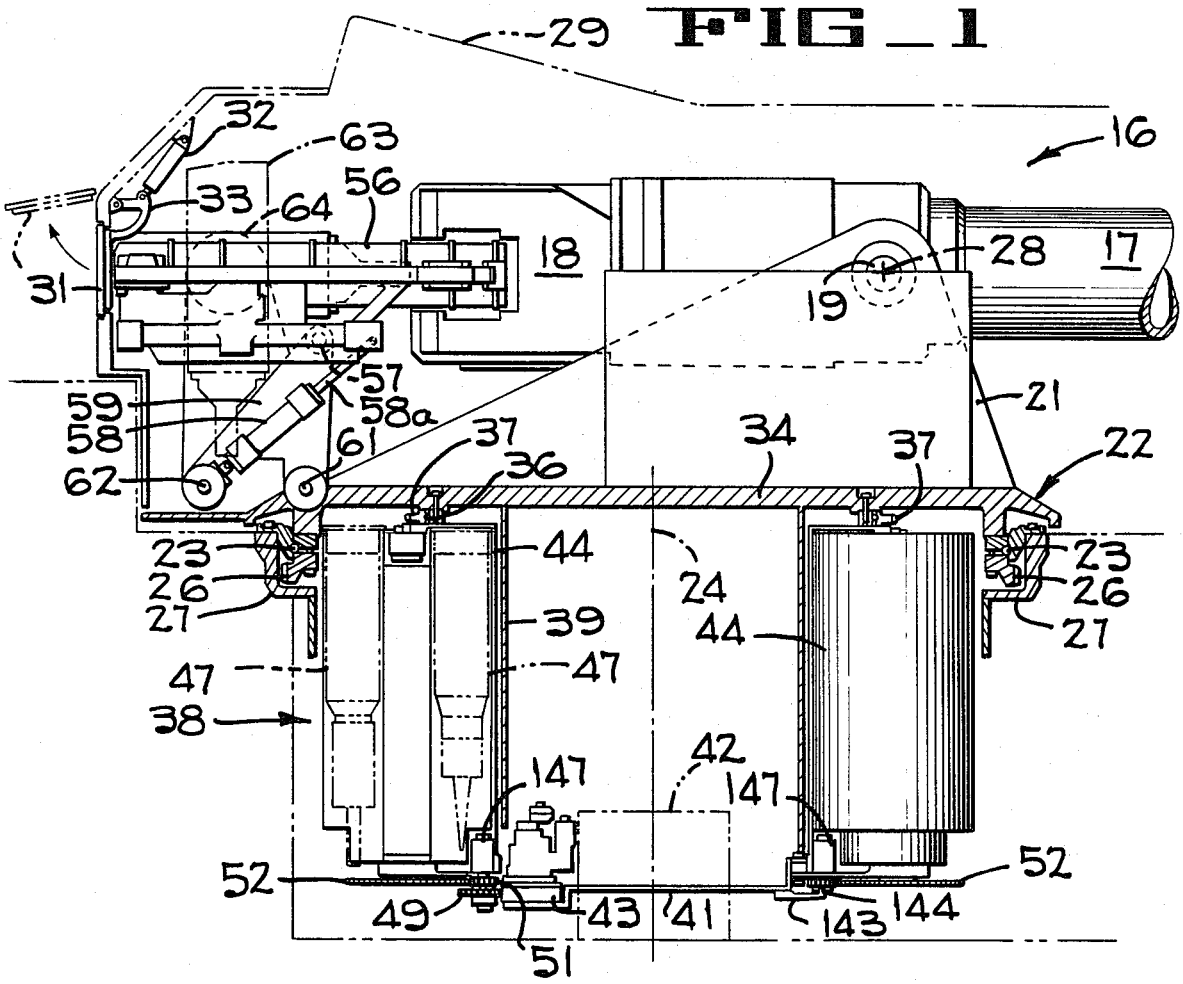
FIG. 1 is a side elevation view partially in section of the automatic loading system of the present invention.
Figure 2:
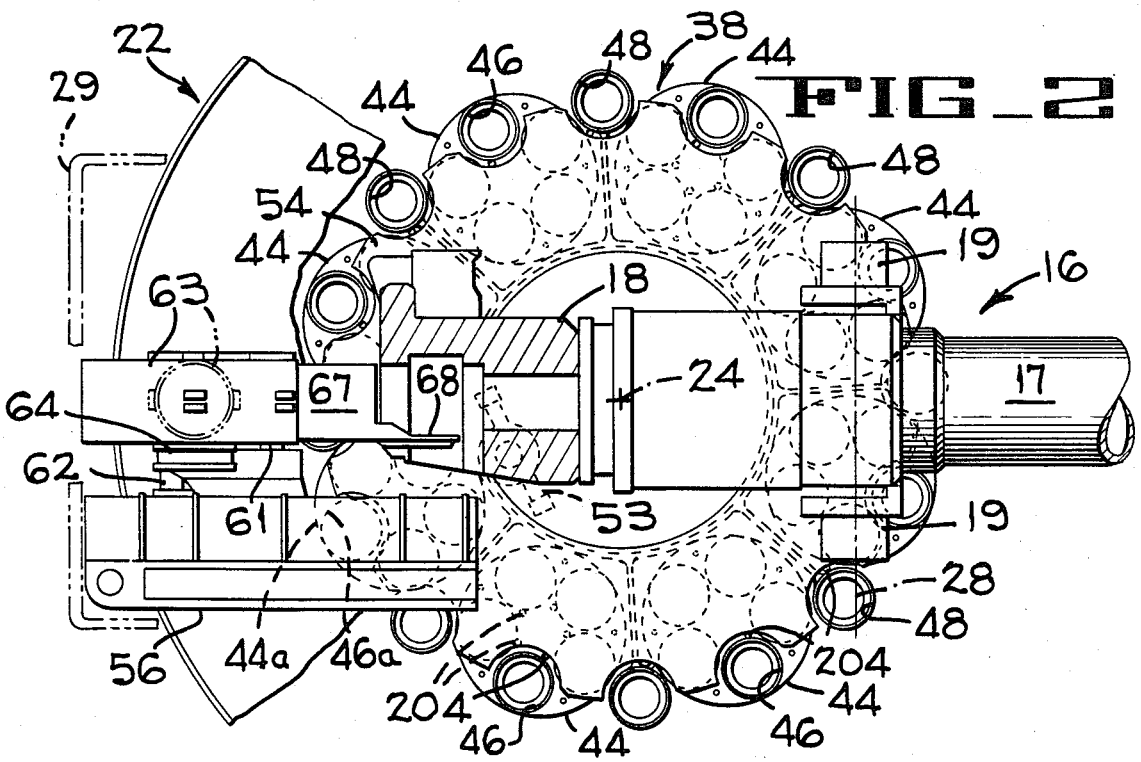
FIG. 2 is a top view partially in section of the automatic loading system of the present invention.

With reference to FIG. 1 of the drawings a large caliber cannon 16 is shown having a forward extending gun tube or barrel 17 and a conventional side loading breech 18 at the rear end of the gun tube. The cannon is supported on trunnions 19 extending from the sides of the cannon. The trunnions are in turn carried in cannon support structure 21 on each side of the cannon which, in this embodiment, is a part of a rotatable turret shown generally at 22. The turret is supported on a circular bearing 23 so that it may be rotated about an azimuth rotation axis 24. Rotation is imparted by engaging a ring gear 26 with an appropriate driving motor and associated coupling gearing (not shown) mounted on a turret support structure seen as item 27 in FIG. 1. As a consequence, the gun may be rotated in azimuth about the turret axis 24 and rotated in elevation about an axis 28 through the trunnions 19, as best seen in FIG. 2. The manner in which the cannon is moved in azimuth and elevation, the way in which the breech 18 is opened and closed to receive ammunition rounds, and the structure by which the spent ammunition round cases are extracted from the breech are all well known in the art and will not be described hereinafter in greater detail.

The automatic loading system is enclosed by removable gun enclosure portions 29 which are attached to the turret 22. The enclosure is shown in dashed lines in FIG. 1. The system does not require any manual operations within the enclosure during normal operations. The enclosure may be seen to have a loading hatch 31 therein which is positioned directly behind the breech 18 when the gun tube 17 is positioned at zero elevation. The loading hatch is actuated between an open (dotted lines in FIG. 1) and closed position by an actuating cylinder 32 which is secured at one end to the inner surface of the enclosure and at the other end to linkage 33 which urges the loading hatch to the open position so that ammunition rounds and spent ammunition cases may be passed through the unobstructed hatch opening in the enclosure. It should be noted, as will be hereinafter described in greater detail, that the loading hatch is opened for stub case ejection, ammunition round misfire ejection, rearming of the turret (replacing ammunition rounds in the carousel) and unloading the turret (removing ammunition rounds from the carousel).

The turret 22 has a flat reinforcing plate 34 as part of the support structure 21 for the cannon 16. Suspended from the plate 34 is a circular bearing 36 which has a ring gear 37 attached to the bearing raceway which moves relative to the turret 22. The ring gear is fixed to a carousel shown generally at 38 in FIGS. 1 and 2. The carousel is annular in shape and rotates about the azimuth axis 24 in a position below the cannon in the turret. The carousel surrounds a depending centrally located cylindrical wall 39 which is a part of the structure of turret 22. The cylindrical wall 39 has a partial floor-like structure 41 at the bottom thereof with a centrally disposed opening therein through which extends a hydraulic and electrical slip ring assembly 42 of a conventional type. The slip ring assembly brings hydraulic and electrical power into the rotatable turret 22 from the turret support structure 27.

As best seen in FIG. 1 a drum drive assembly 43 is mounted on the bottom partial wall 41 attached to the turret 22. The carousel 38 has a number (eight in this embodiment) of drums 44 mounted about its periphery. The drums are mounted for rotation about axes substantially parallel to the azimuth axis 24 and the axis of rotation of the carousel 38. Each drum in this embodiment has five storage cells 46 adapted to receive fixed ammunition rounds (shown in dashed lines at 47) which may be of several types including the Sabot (armor piercing) or heat (high explosive) rounds as shown. Additional storage cells 48 may be fixed to the carousel 38 between the drum positions to thereby provide a total of forty-eight storage cells as seen most clearly in FIG. 2. The ammunition rounds 47 are supported within the cells 46 and 48 by means to be hereinafter described in greater detail.

The drum drive assembly 43 is configured to rotate an intermediate gear 49 which is in turn coupled to a drum drive coupling gear 51 which is mounted rotatably on the carousel 38 at each of the positions on the carousel where a drum 44 is located. The manner in which gear 51 is coupled to intermediate gear 49 will be explained hereinafter. Gear 51 is in turn meshed with a drive gear 52 for each of the drums 44. The drum drive gear 52 is attached to the drum shaft for each drum 44 and, when driven by gear 51, causes the drum to rotate so that a predetermined cell 46 may be positioned rotationally into a transfer position. When a drum is positioned in the drive position 44*a*, it may be rotated so that one of its cells 46 is brought to the transfer position indicated in FIG. 2 as 46*a*. A hydraulic drive cylinder 53 is seen in dashed lines in FIG. 2 which provides the drive power source for the drum drive assembly 43 and which will be described in greater detail hereinafter.

The carousel has a top plate 54 which is best seen in FIG. 2 as having a somewhat scalloped periphery so that cells positioned in the transfer position 46*a* may be accessed from above. The top plate 54 supports the upper bearings for each of the drums 44. As may be seen from what has been described hereinbefore, a specific cell 46 or 48 may be positioned at the transfer position 46*a* by indexing the carousel 38 in combination with rotation of the drum 44 at the drum drive position 44*a*.

A transfer tray assembly 56 is seen in FIGS. 1 and 2 in the horizontal or intermediate position between a transfer position aligned with the axis of the storage cell 46*a* and a position laterally displaced from that shown in FIG. 2 in alignment with the breech 18 of the cannon 16. The transfer tray assembly is rotatable about a pivot axis 57 (dashed lines in FIG. 1) by a hydraulically actuated piston and cylinder assembly 58. When the actuator 58 is energized to retract the piston rod 58*a* extending therefrom, the transfer tray assembly assumes a position with its long axis vertically disposed as seen in FIG. 1 and in alignment with the cell 46 or 48 at the transfer position 46*a*. A fixed end of the hydraulic actuator 58 and the pivot point 57 are on a carriage 59 which supports the transfer tray assembly for rotation thereon. The carriage is in turn mounted for lateral sliding movement on a pair of tracks 61 and 62 so that the transfer tray assembly 56 may be moved laterally from the position seen in FIG. 2 into a position in alignment with and behind the breech 18.

Also mounted on the carriage 59 is a case eject tube assembly 63. The tube assembly moves laterally with the transfer tray assembly 56 and is also rotated about the center of a boss 64 (FIG. 2) into a position with its elongate axis disposed vertically as seen in dashed lines in FIG. 1. The rotation of the empty case guide tube from the position shown in FIG. 2 aligned with the opening in the breech 18, to the position shown in dashed lines in FIG. 1 is accomplished by a hydraulic actuator (not shown). The guide tube 63 has a telescoping inner sleeve 67 (FIG. 2) which has a "nose" 68 at the side thereof so that once rotated into the position shown in FIG. 2 aligned with the opening in the breech 18, the telescoping portion 67 may be extended. An ejected spent ammunition case will thus be directed into the telescoping portion of the guide tube and will not fly out of the side opening in the breech 18. As mentioned hereinbefore, when a spent ammunition round case is ejected (by well known means) from the gun breech and guided in its rearward flight through the guide tube 63, the loading hatch 31 is actuated into an open position by the actuator 32 so that the case may fly outside the enclosure 29. It may therefore be seen that actuation of the carriage 59 laterally on the rails 61 and 62 alternately places the transfer tray assembly 56 and the case eject guide tube assembly 63 in a position behind the gun breech 18. The actuator for lateral motion of the carriage 59 and the manner in which it provides lateral motion of the carriage will be described in greater detail hereinafter.

Figure 3:
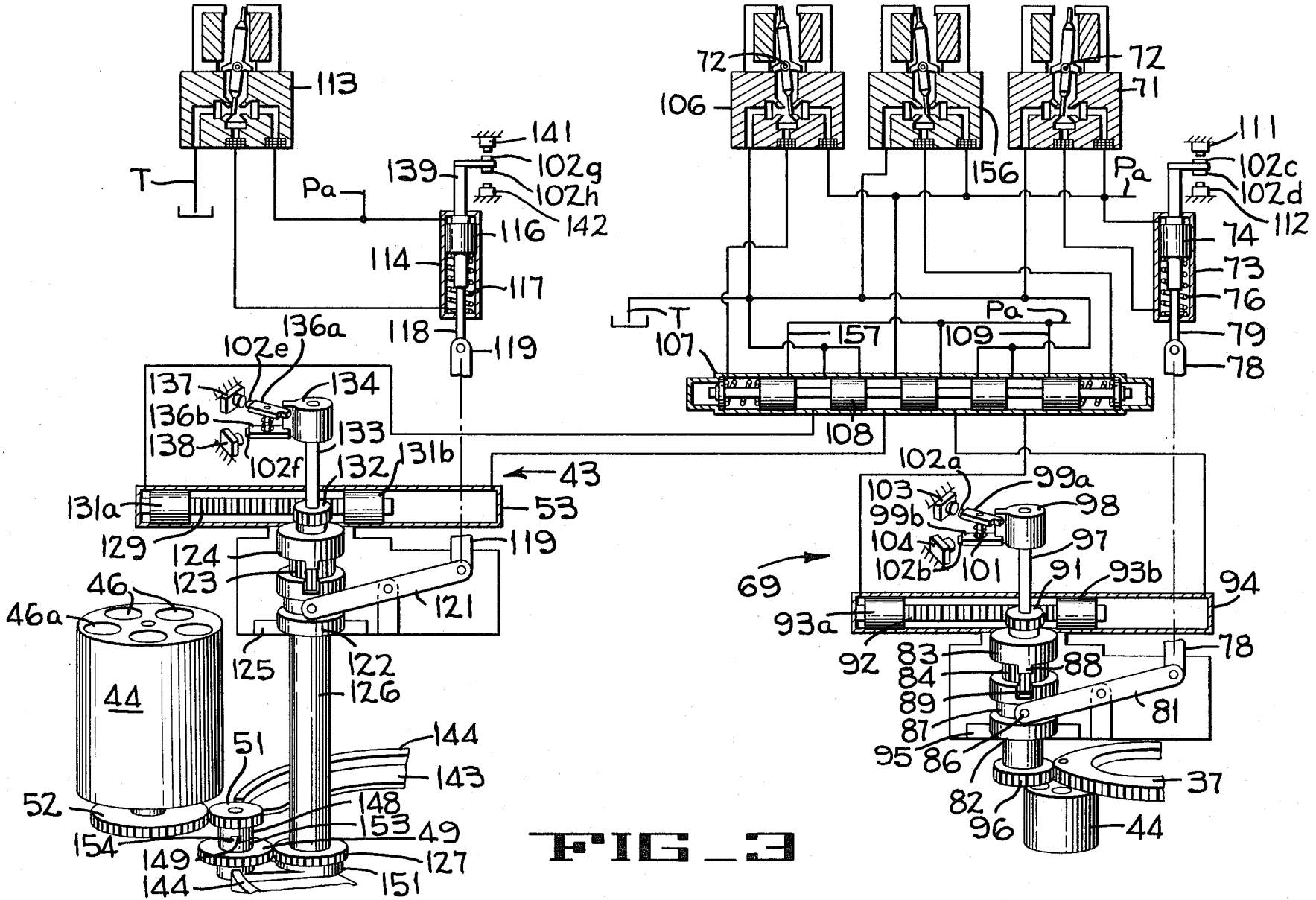
FIG. 3 is a hydraulic and mechanical schematic of a carousel assembly in one embodiment of the automatic loading system.

Turning now to the mechanical and hydraulic schematic drawing of FIG. 3, the carousel 38 is represented by the carousel ring gear 37 which is driven to impart rotation to the carousel about the azimuth axis 24. The ring gear is in turn attached to carousel structure on which the rotating drums 44 are mounted. The carousel index drive is shown in FIG. 3 generally at 69 in schematic fashion as it could not clearly be shown in appropriate detail in either FIGS. 1 or 2. A nozzle flapper valve 71 is shown schematically. The flapper valve is available as a commercial item from Hydraulic Servo Controls Corporation through their technical representatives in Cary, Ill. and is a solenoid operated three way-two position device which causes a flapper to pivot about a pivot 72 to close off one or the other of two side ports within the body of the valve thereby communicating the other side port with the bottom or middle port within the body of the valve. In this fashion the middle port emanating from the valve may be communicated with either the pressure side (Pa) or the tank side (T) of a hydraulic system as will be hereinafter explained. The nozzle flapper valves shown hereinafter will be described as being actuated or returned to a position with the flapper (bottom portion of the pivoting element) positioned to the right or to the left within the valve body to obtain the subsequently described operations. It may be seen for example that valve 71 with the flapper position to the left as shown communicates pressure, Pa, through the right side valve port and through the bottom valve port to the bottom side of a carousel drive clutch engagement cylinder 73. A piston 74 is contained within the cylinder 73. The piston has a larger area on the lower face than on the top face. Pressure is also communicated to the top end of the cylinder so that the piston 74 contained therein has a net force thereon in an upward direction as shown. A compression spring 76 contained within the cylinder 73 aids the net upward force on the piston 74 to urge it toward the upper end of the cylinder as shown. With the flapper of valve 71 positioned as shown, the piston 74 is therefore positioned as shown in FIG. 3 and linkage 78 attached to a piston rod 79 is actuated so that a lever 81 is positioned to disengage a clutch member 82 from a rotationally driven member 83. The clutch member may be seen to be slidable axially on a spline 84 by movement of the lever 81. The lever 81 has an end mounted pin 86 which enters a groove 87 on the clutch member so that the clutch member may be urged axially by the lever and may also be urged rotationally by the driven member 83 whereby the pin rides in the groove 87 as the clutch member rotates. The driven member 83 rotates independently of the spline 84 and has one or more ears 88 which enter a like number of slots 89 in the clutch member when the lever 81 urges the clutch member upwardly on the spline as seen in FIG. 3. The driven member 83 has a pinion gear 91 attached thereto which is in engagement with a rack 92 connected between piston ends 93*a* and 93*b*. The piston ends are enclosed by a cylinder 94. Hydraulic pressure may be introduced into the ends of the cylinder to drive the pistons translationally within the cylinder and thereby drive the rack 92 in one direction or the other to cause rotation of the pinion 91. The rotary driven member 83, a pinion 91, shaft 97 and switch actuating cam 98 are capable of independent rotation together relative to the spline 84 and an attached shaft and carousel drive gear 96 situated therebelow. The carousel drive gear 96 is meshed with the ring gear 37 on the carousel. The carousel drive gear is therefore driven only when the rack 92 is driven and the clutch member 82 is moved along the spline 84 so that the ears 88 are engaged within the slots 89 on the clutch member.

The pinion gear 91 has the aforementioned shaft 97 attached thereto, upon the end of which is fixed the switch actuating cam 98. Two spring loaded switch arms 99*a* and 99*b* are pivotally mounted on a pin 101. The switch arms have a proximity switch disc 102*a* and *b* on the ends thereof so that when the switch actuating cam 98 is in the position shown in FIG. 3 the switch arm 99*a* is rotated on the pin 101 against the spring force to align the switching disc 102*a* with a proximity switch 103. The switch 103 thereby provides a signal indication that the rack 92 is positioned as shown in FIG. 3. When the rack is driven to the opposite end of the cylinder 94, the switching cam 98 travels through 360° allowing the spring force on the switching arm 99*a* to pivot the disc 102*a* away from the switch 103. The cam repositions switch arm 99*b* to bring the similar disc 102*b* adjacent another proximity switch 104 which provides a signal indication that the rack position is at the opposite end of the cylinder 94.

Referring yet to FIG. 3 there appears a nozzle flapper valve 106 which is shown in a position to block pressure at the valve. When the valve 106 is actuated to pivot the valve flapper member about the pivot point 72 (as in valve 71) pressure will be introduced into the left end of a pilot valve 107 which is illustrated as spring loaded to a neutral position as shown in FIG. 3. The pressure introduced into the left end of the pilot valve 107 causes a piston 108 having a plurality of lands thereon to shift to the right as seen in the Figure so that pressure is blocked through the pilot valve to the right end of carousel drive cylinder 94 and that end of the drive cylinder is communicated with the hydraulic system tank, T, through the pilot valve. Hydraulic pressure is communicated through a pressure line portion 109 to the left end of the cylinder 94 as seen in FIG. 3 thereby driving the rack 92 to the right and turning the pinion gear in a clockwise direction (looking from the top).

Actuation of valve 106 and the subsequent rotation of the pinion gear 91 will have no effect until valve 71 is actuated to close off the right side pressure port within the valve body. Pressure is then applied only to one side of the piston 74 (the top) within the cylinder 73 and the piston is lowered within the cylinder. The rod 79, linkage 78 and lever 81 thereby cause the clutch member 82 to be raised on the spline 84 so that the ears 88 engage the slots 89. Now when the valve 106 is actuated to allow hydraulic pressure to be communicated to the left end of the cylinder 107 as hereinbefore described, the motion of the rack 92 causes the carousel drive gear 96 to rotate in a clockwise direction and therefore moves the carousel ring gear 37 and the carousel in a counterclockwise direction. The gear ratios and rack length are such as to drive the carousel through an indexing increment of 22½ degrees for the carousel configuration of FIG. 2. It should be noted that the carousel index drive increment may be adjusted to provide an appropriate angular drive increment such as 15° for the carousel embodiment depicted in FIG. 12 for example. It should further be noted that when the piston 74 is in the position shown in FIG. 3 another proximity switch disc 102*c* is adjacent a proximity switch 111. The disc is affixed to an extension from the piston extending through the wall of the cylinder. As a consequence the proximity switch 111 provides a signal which indicates that the clutch member 82 is disengaged from the rack and pinion driving mechanism in the carousel drive 94. The clutch member and therefore the carousel drive gear are locked rotationally by members 95 which contact the clutch member in this condition. However, when the valve 71 is actuated to block the right side pressure port within the valve body and the piston 74 is driven downward within the cylinder 73 against the force of the spring 76 as hereinbefore described, another proximity switch disc 102*d* is brought adjacent to a proximity switch 112 which provides a switch signal indicative of engagement between the clutch member 82 and the driven member 83.

FIG. 3 shows another nozzle flapper valve 113 which is configured in the same fashion as the valve 71 and is attached to a hydraulic actuating cylinder 114 within the drum drive assembly 43. The cylinder 114 performs a function similar to that performed by hydraulic actuating cylinder 73 described hereinbefore. It may be seen that when valve 113 is configured so that the flapper is positioned as shown, a piston 116 is urged upwardly within the cylinder by the net force provided as discussed in conjunction with cylinder 73 and by a spring 117. When the flapper is actuated to cover the right side port within the valve body a pressure is applied to the top side of the piston 116 whereby a piston rod 118 and linkage 119 causes a lever 121 to move a clutch member 122 on a spline 123 into engagement with a rotating driven member 124. The driven member is capable of rotation independently of the spline 123 (in the same fashion as the driven member 83 and the spline 84), so that when the clutch member is disengaged from the driven member no rotary motion is imparted to the clutch member 122, its integral shaft 126 and a drum drive gear 127 affixed to the shaft. Moreover, the clutch member is fixed rotationally by members 125 (similar to members 95) when disengaged from member 124 so that the shaft and drum drive gear are rotationally locked. It may further be seen in FIG. 3 that the drum drive cylinder 53 (first memtioned with reference to FIG. 2) contains a rack 129 having piston portions 131*a* and 131*b* at opposite ends thereof within the cylinder 53. The rack 129 is meshed with a pinion gear 132 fixed to a shaft 133 extending from the side of the cylinder. A switch driving cam 134 is fixed to the end of the shaft. A pair of pivoting spring loaded arms 136*a* and 136*b* have proximity switch discs 102*e* and *f* affixed to the ends thereof. When switch arm 136*a* is disposed as shown in FIG. 3, a proximity switch 137 provides a signal indicating that the rack 129 is in the position shown in FIG. 3, prepared to drive an ammunition drum 44 in a clockwise direction. In the fashion described in conjunction with the carousel index drive switching arms 99*a* and 99*b*, when the switch drive cam 134 is caused to rotate 360° by transition of the rack 129 to the right end of the cylinder 53, another proximity switch 138 is actuated to provide a signal indicative of that drum index drive configuration. It should be noted that proximity switches are also provided to monitor the position of the actuating piston 116 in the drum index drive so that a signal is provided indicating whether or not the clutch member 122 is engaged or disengaged from the driving member 124. An extension 139 from the piston 116 has a pair of proximity switch discs 102*g* and *h* thereon. A proximity switch 141 provides a clutch disengage indicative signal and a proximity switch 142 provides a clutch engage indicative signal in accordance with the position of the piston 116 within the cylinder 114 for disengagement and engagement of the clutch member 122 by the drive member 124 as hereinbefore described. It should further be noted that the drum and carousel drives may operate in clockwise or counterclockwise senses depending on the sequencing of rack drive and clutch engagement.

Turning briefly to FIG. 1, an annular shaped member 143 is seen attached to the floor 41 of the depending cylindrical wall 39. A portion of the annular member is shown in FIG. 3 where it is seen to have an upwardly extending flange 144 around the outer edge thereof. The drum drive coupling gear 51 (FIGS. 1 and 3) is fixed to the carousel at each drum position thereon and is supported in a journal housing 147 (FIG. 1). A boss 148 extends from the lower surface of the drum drive coupling gear having an elongate curved slot 149 across the face thereof. The curvature in the slot is the same as the curvature on the flange 144. There is an opening as seen in FIG. 3 in the annular member 143 at the drum drive position occupied by the drum designated 44*a* in FIG. 2. The opening allows the drum index drive 43 to extend through the annular member. The drum drive gear 127 is supported in a member 151 which also supports the intermediate gear 49 (FIGS. 1 and 3) having a boss 153 extending from the top thereof. This last named boss has a curved land 154 across the face thereof. The land is formed to fit within the slot 149 so that when the land is within the slot and the drum drive gear 127 drives the intermediate gear 49, the drum drive coupling gear 51 will be rotated with the intermediate gear. The drum drive coupling gear is meshed with the drum drive gear 52 also seen in both FIGS. 1 and 3. It should be noted that one pass of the rack 129 by the pinion gear 132 when the clutch member 122 is engaged with the driven rotating member 124 will cause the drum 44 in the drum drive position 44*a* to rotate one-fifth of one turn (72°) so that the adjacent storage cell 46 may be advanced into the storage cell transfer position indicated as 46*a* in FIGS. 2 and 3. It should be recognized that as the carousel 38 is rotated the slots 149 in the drum drive coupling gears 51 are maintained in alignment by riding on the flange 144 until the coupling gear is brought into the opening in the annular member 143 and the slot is engaged by the land 154 on the intermediate gear 49. In this fashion the drum index drive mechanism is able to drive the drum 44 which occupies the drive position 44*a* rotationally while all other drums 44 on the carousel are locked rotationally by the flange 144.

FIG. 3 shows another nozzle flapper valve 156 wherein the right side port in the valve body is closed by the flapper. When the valve 156 is actuated to move the flapper away from the right side port, pressure is introduced through the valve into the right end of the pilot valve 107 thereby moving the piston 108 having the plurality of lands to the left as seen in FIG. 3. A leftward motion communicates pressure through a pressure line portion 157 at the pilot valve 107 to the left end of the cylinder 53 as seen in FIG. 3. The rack 129 is thereby driven to the right in the Figure to rotate the pinion gear 132. When the flapper valve 113 is actuated the pressure from the right side pressure port in the valve body is blocked and the piston 116 is driven downwardly in the cylinder 114 thereby engaging the clutch member 122 with the driven member 124 and the pinion gear 132. The aforementioned motion of the rack 129 as selected by the valve 156 causes a 72° rotation of the drum 44 in the drum drive position through the motion of the mechanism hereinbefore described.

Figure 4:
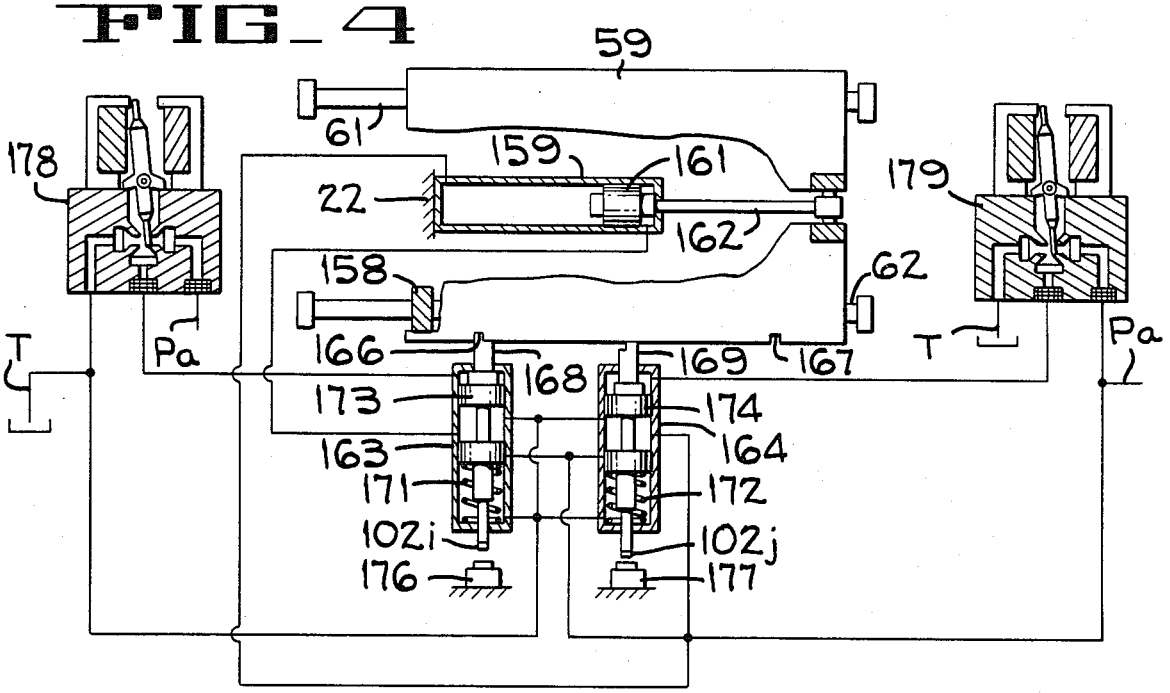
FIG. 4 is a hydraulic and mechanical schematic of a carriage traverse drive in one embodiment of the automatic loading system.

When the drum 44 in the drive position 44*a* has been positioned rotationally to bring a storage cell 46 into the transfer position 46*a*, the transfer tray assembly 56 must be positioned to either deposit an ammunition round in or withdraw an ammunition round from the storage cell. With reference now to FIG. 4 structure is shown which provides for the lateral movement of the carriage 59, and therefore the transfer tray assembly, on the two laterally extending tracks 61 and 62. The transfer tray carriage assembly provides mechanism to rotate and translate the transfer tray assembly and to identify the type of ammunition round being transferred. The carriage structure includes four linear bearings 158, one at each corner of the carriage as seen in FIG. 4 and one of which is shown in FIG. 4. The bearings are configured to ride on the lateral tracks 61 and 62 and are positioned so that two of the bearings support the carriage on each track. A traverse drive cylinder 159 has a piston 161 situated therein with a rod 162 extending therefrom. The end of the rod is pivotally attached to the carriage. The traverse drive cylinder is mounted on the turret structure 22 and moves the carriage 59 between a hoist position as shown in FIG. 4 and a position more directly behind the gun breech at the other end of the tracks 61 and 62. With the carriage in the hoist position, the transfer tray assembly 56 may be rotated into alignment with the storage cell in the transfer position 46*a* (FIG. 2). With the carriage shifted to the opposite end of the tracks from that shown in FIG. 4, the transfer tray assembly is aligned with the breech and may be used for ramming an ammunition round into the gun breech, extraction of a misfired round from the breech, rearming the magazine or off-loading ammunition rounds taken from the magazine.

Mounted on the turret structure is a hoist position latch 163 and a ram position latch 164. The carriage has a hoist position latch notch 166 and a ram position latch notch 167 formed therein. A latch member 168 extends from the hoist latch and a latch member 169 extends from the ram latch. The latch members are attached to pistons 173 and 174 which are urged outwardly by compressed coil springs 171 and 172 in the hoist and ram latches respectively. The hoist latch member 168 is seen engaged in the latch notch 166 in FIG. 4. The latch member 169 rides on the carriage surface as shown until the carriage is moved to place notch 167 in line with the latch member whereupon the carriage is latched at the ram position. Extensions on the pistons 173 and 174, have proximity switch discs 102*i* and *j* attached thereto so that a switch indication is provided from proximity switches 176 and 177 signifying when the carriage is latched either in the hoist position (as shown) or the ram position.

A nozzle flapper valve 178 when actuated opens the right side port within the valve body allowing hydraulic pressure to be communicated to the top of the hoist position latch cylinder 163 thereby forcing the piston 173 downward against the compression spring 171 as seen in FIG. 4. This causes the latch member 168 to be withdrawn from the hoist position latch notch 166 and further communicates hydraulic pressure through the cylinder 163 to the right side (FIG. 4) of the traverse drive cylinder piston 161. The piston is moved toward the left end of the traverse drive cylinder 159 carrying the carriage 59 to the ram position where the latch member 169 is forced into the ram position latch notch 167 by the spring 172 thereby holding the carriage in that position. Another nozzle flapper valve 179 is provided which when actuated opens the right side port within the valve body communicating hydraulic pressure to the top of the piston 174 within the ram position latch 164. The latch member 169 is thereby withdrawn from the latch notch 167 and pressure is communicated through the cylinder 164 to the left end of the cylinder 159 as seen in FIG. 4. The pressure exerted within the traverse drive cylinder forces the piston 161 and the carriage 59 back to the position shown in FIG. 4 whereupon the latch member 168 once again sets within the hoist position latch notch 166.

Figure 5:
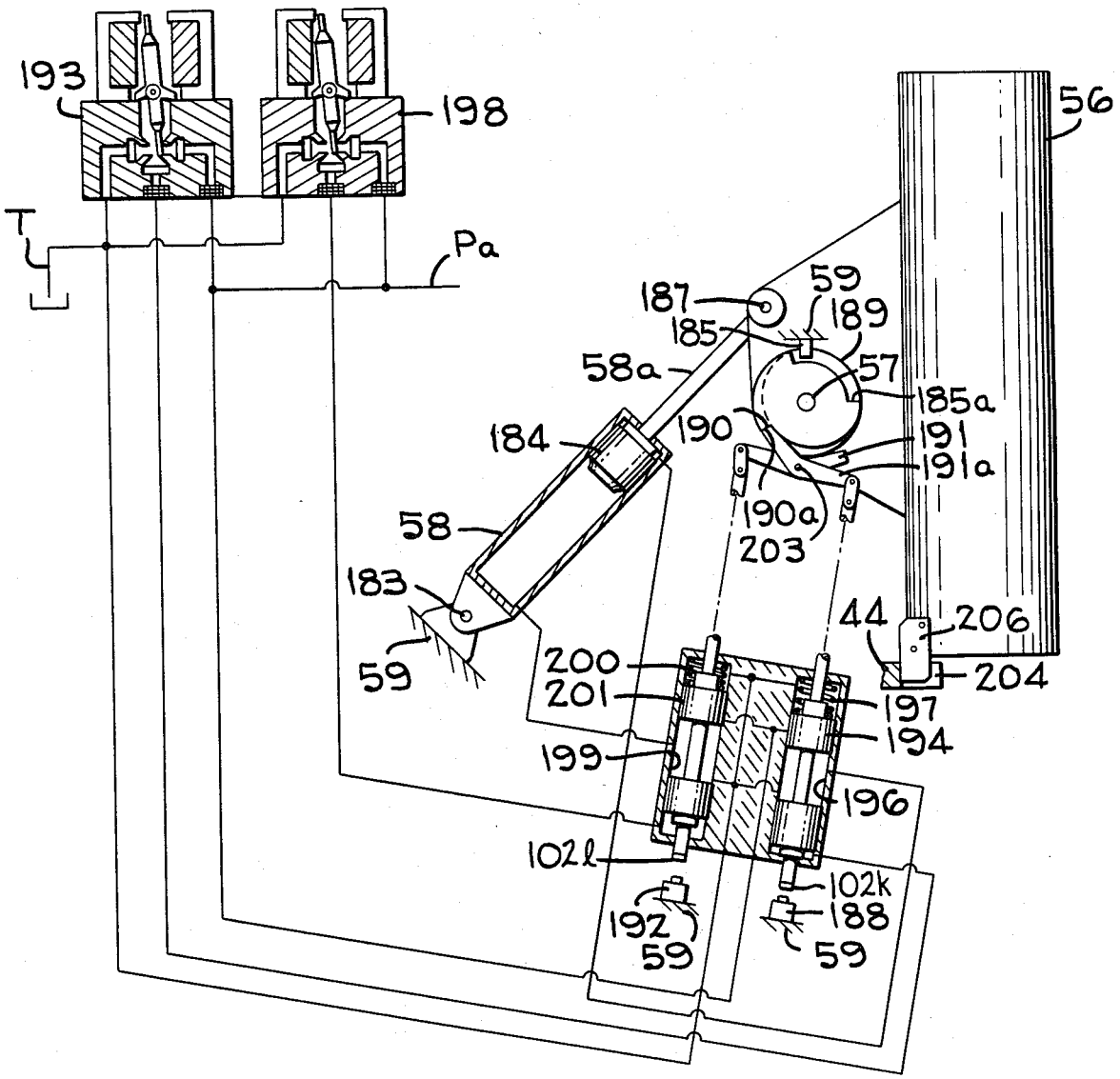
FIG. 5 is a hydraulic and mechanical schematic of a transfer tray rotation drive in one embodiment of the automatic loading system.

The transfer tray assembly 56 is shown in FIG. 5 mounted on the carriage 59 and attached thereto at the pivot 57. The transfer tray assembly is shown in the vertical position in FIG. 5 and is rotated between a vertical and a horizontal position about the pivot 57 on the carriage by means of the hydraulic actuator 58 which is mounted at a pivot 183 also on the carriage 59. A piston 184 is contained within the hydraulic actuator having a rod 58*a* attached thereto which extends through the wall of the actuator and is pivotally attached at a point 187 on the transfer tray assembly. A latching cam 189 is attached at the pivot 57 for the transfer tray assembly 56. When the transfer tray is rotated 90° from the position seen in FIG. 5 by energizing the actuator 58 so that the rod 58*a* is retracted, a tray latch bell crank 191 pivoted at a point 203 on the carriage engages a notch 190 (shown in dashed lines) in the latching cam 189 to maintain the tray in a horizontal position. The latching cam 189 has another notch 190*a* which is engaged by a tray latch bell crank 191*a* to maintain the tray in the vertical position as seen in FIG. 5. The two bell cranks pivot about point 203.

When the transfer tray assembly 56 is to be moved to the horizontal position, a nozzle flapper valve 193 is energized causing the right side port in the valve body to be unblocked, thereby communicating hydraulic pressure to the lower end of a piston 194 within a cylinder 196 in a valve block as seen in FIG. 5. The piston is thereby urged upwardly within the cylinder against a coiled compression spring 197. The motion of the piston 194 causes the bell crank 191*a* to rotate about the point 203, to remove latch 191*a* from notch 190*a*. Hydraulic pressure is communicated through the cylinder 196 to the upper or right end of the cylinder 58 against the upper face of piston 184. The opposite face of the piston may be seen to be communicated to tank, T, through a cylinder 199 containing a piston 201 therein. The rod 58*a* is thereby retracted bringing the unlatched transfer tray assembly to a horizontal position where it is latched as the end of the bell crank 191 falls into the notch 190. When the actuating signal is removed from the valve 193 the flapper returns to the position shown in FIG. 5, pressure is removed from the cylinder 58, and the transfer tray is held in place in the horizontal position by the mechanical latch. A stop 185 on the carriage 59 is engaged by a surface 185*a* on the latching cam 189 to position the transfer tray 56 in the proper position horizontally. Another switch (not shown) provides a signal indicating the transfer tray is clear of the drum 44 structure.

Another nozzle flapper valve 198 is seen in FIG. 5 which when actuated causes a flapper to be removed from the face of a right side port within the valve body so that pressure is communicated to the lower end of the hydraulic cylinder 199 causing the piston 201 therein to be urged upwardly against a compression spring 200 as seen in FIG. 5. A rod is attached to the piston 201 and extends from the hydraulic cylinder. The rod is attached to the tray latch bell crank 191 which is caused to pivot about the point 203 to cause the latch to rotate out of the notch 190 in the latching cam 189. The movement of the piston 201 shuts off the tank or return line at cylinder 199 and communicates hydraulic pressure to the lower side of the piston 184 causing the rod 58*a* to extend and rotate the transfer tray assembly 56 back to the vertical position shown. When the actuating signal is removed from the valve 198 the flapper returns to the position shown in FIG. 5, pressure is blocked from the cylinder 58 through cylinder 199 and the transfer tray is held in the vertical position by the mechanical latch 190/190*a*. It should be noted that a proximity switch disc 102*k* is fixed to the lower end of an extension rod from piston 194 and a proximity switch 188 is attached to the carriage so that a signal is provided to indicate the transfer tray assembly is in the vertical position as seen in FIG. 5. Another proximity switch disc 102*l* is fixed to the lower end of an extension from piston 201 so that it may be brought adjacent a proximity switch 192 on the carriage when piston 201 is lowered in cylinder 199. This provides a switch output wherein an indication is provided signifying the tray assembly is in the horizontal position and is latched there.

As also shown in FIG. 5, when the tray assembly 56 is rotated to the vertical position a blade 206 enters an alignment slot 204 in the drum 44*a* in the drive position. Each of the drums 44 has a group of such slots, indicated at points 204 in FIG. 2, one alignment slot for each cell 46. Only a few of the alignment slot patterns are shown in the tops of the drums 44 to preclude cluttering the view. Those alignment slots visible from above past the scalloped periphery of the top plate 54 are also shown. The guide slots 204 serve to align the cell 46*a* in the transfer position with the transfer tray assembly 56 in both lateral directions.

Figure 6:
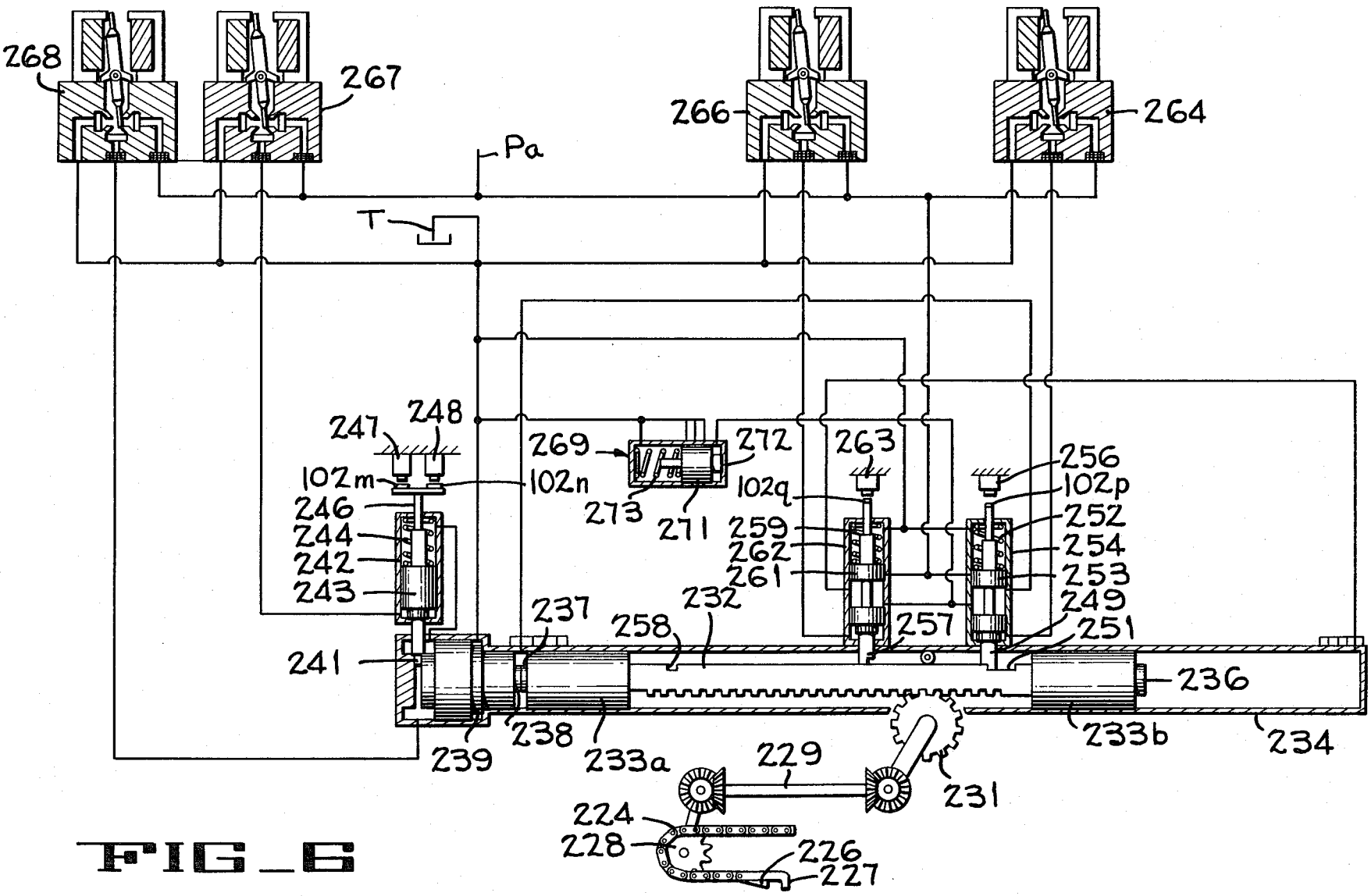
FIG. 6 is a hydraulic and mechanical schematic of the hoist and rammer in one embodiment of the automatic loading system.

Turning now to FIG. 6 of the drawings the mechanism which performs the ammunition round hoisting and ramming functions will be described. The transfer tray assembly 56 has a roller chain track in which is disposed a roller chain 224. The roller chain is the type which may be pushed or pulled within the track. A ram pawl 226 and a hoist pawl (or ram latch) 227 are shown attached to one end of the roller chain. The roller chain is driven by a sprocket 228 which in turn is driven through a series of beveled gears and shafts 229 coming off of a pinion gear 231. The pinion is driven by a rack 232 which is attached between complementary pistons 233*a* and 233*b*. The pistons are driven along a hydraulic cylinder 234 by appropriate application of hydraulic pressure to the ends of the cylinder. The piston 233*b* has a stop 236 thereon which stops the rack movement when the stop contacts the end of the cylinder. The piston 233*a* has a stop 237 thereon which arrests the rack movement when the stop contacts a mating stop 238 attached to a misfire cylinder 239 in the left end of the hydraulic cylinder 234 as seen in FIG. 6. The piston 239 may be seen to be spaced from the left end of the cylinder 234 by a misfire latch pin 241. The gear ratios in the pinion 231 and the series of gears and shafts 229 is such that about one inch of movement of the rack 232 provides about five inches of movement of the roller chain 224. Thus, when the misfire latch pin 241 is removed from the space between the left end of the piston 239 and the end of the cylinder 234 the rack may move within the cylinder by that additional amount of length before the stop 237 contacts the stop 238 thereby providing about an additional inch and a half of roller chain travel. This additional travel is needed when a misfire is engaged by the hoist pawl and withdrawn from the gun breech. The hoist pawl withdraws a misfired round from the gun breech 18 and a cam (not shown) moves the ram pawl 226 away from the backside of a flange on the base of an ammunition round during the additional one and one half inches of roller chain and pawl travel so that the inertia of the misfired round being withdrawn will carry the round out the rear end of the transfer tray assembly 56 and through the opened loading hatch 31.

Actuation of the misfire latch pin is accomplished by a hydraulic cylinder 242 (FIG. 6) containing a piston 243 therein which is spring loaded by a compression coil spring 244 into the latch extended position as shown. A pair of proximity switch discs 102*m* and *n* are situated on an extended rod 246 attached to the misfire latch piston 243. A pair of proximity switches 247 and 248 are attached to the transfer tray assembly structure to provide separate signals indicative of the misfire latch being engaged or disengaged respectively.

The rack 232 is latched at the left end of the cylinder 234 as seen in FIG. 6 by means of a latching member 249 which enters a latch detent 251 on the rear face of the rack. The rack is thus latched in the ready to ram position. The latch member is urged into the detent by a compression coil spring 252 which bears against a piston 253 within a hydraulic cylinder 254. A proximity switch disc 102*p* fixed to an arm extending from the piston 253 which functions in conjunction with a proximity switch 256 to provide a signal indicative of the position of the latch member 249. Another latch member 257 is disposed to ride on the back surface of the rack 232 in the position shown in FIG. 6 until the rack has moved to the right in the Figure to bring a latching detent 258 into alignment with the latching member 257. The latching member is urged toward the extended or latched condition by a coil compression spring 259 bearing against a piston 261 to which the latch member is attached. The piston is contained within a hydraulic cylinder 262. An extension from the piston 261 has a proximity switch disc 102*q* on the end thereof which is adjacent to a proximity switch 263 when in the unlatched condition, thereby providing a signal indicative of whether the latch member 257 is engaged in the latch detent 258 or not.

In operation the hoist and rammer drive is actuated by operation of a nozzle flapper valve 264 which removes a flapper from the right side port within the valve body to thereby communicate pressure with the bottom face of the latch piston 253. The latch member 249 is thereby lifted from the detent 251 and pressure is communicated through the hydraulic cylinder 254 to the left face of piston 233*a* within the cylinder 234. The rack 232 is thereby driven to the right as seen in FIG. 6 causing the ram pawl 226 to advance to the right and to ram an ammunition round into the breech of the cannon when the transfer tray assembly 56 is in the horizontal position aligned with the breech. Another nozzle flapper valve 266 is configured so that when it is energized a right side port is unblocked by moving the flapper away therefrom and pressure is communicated through the valve to the bottom face of the piston 261. The latch member 257 is thereby lifted from the detent 258 against the force exerted by the compression spring 259 and the signal output from proximity switch 263 is changed. Hydraulic pressure is communicated through the hydraulic cylinder 262 to the right end of the cylinder 234 against the face of the piston 233*b*. The rack 232 is thereby driven to the left as seen in FIG. 6 rotating pinion 231 and retracting the hoist and rammer pawls 227 and 226.

When a misfire occurs within the gun breech, the immediately preceding description providing movement of the rack 232 to the left in FIG. 6 occurs together with actuation of a nozzle flapper valve 267. Hydraulic pressure is communicated through the valve when the right side port within the valve body is unblocked by movement of the flapper away therefrom and the pressure is directed to the bottom side of the piston 243. The piston is lifted within the cylinder 242 against compression of the coil spring 244 thereby withdrawing the misfire latch pin 241 from its position between the piston 239 and the stop at the left end of the cylinder 234. The rack 232 thereby has an added distance through which it may travel as it moves the piston 239 to the left end of the cylinder thereby providing the additional retraction distance of the hoist pawl 227. As mentioned hereinbefore, the ram pawl 226 is cammed out of the way at the end of the roller chain retraction travel so that a misfired round may continue rearward through the transfer tray assembly 56 unimpeded and out through the opening in the gun enclosure 29 when the hatch cover 31 is actuated to the open condition as seen in dashed lines in FIG. 1. Once the misfired ammunition round has been ejected from the system, another nozzle flapper valve 268 is energized introducing pressure to the left face of piston 239 as seen in FIG. 6. At the same time the flapper valve 267 is returned to the position shown in FIG. 6 and pressure is removed from the bottom side of the piston 243. The piston thereby moves downwardly due to the force applied by the spring 244 and pressure applied to the top of piston 243 through the end of the cylinder 234 adjacent to the piston 239 (FIG. 6). When the piston 239 has moved to the point where a shoulder on the piston abuts an internal shoulder in the cylinder 234 the misfire latch pin will be forced into the space between the piston 239 and the far left stop in the cylinder 234.

The return line to the tank T in the hydraulic system portion shown in FIG. 6 has a relief valve 269 disposed therein. It may be seen that pressure applied to the right face of a piston 271 within a cylinder 272 will cause the piston to move leftward against the force exerted by a coil spring 273. The higher the pressure the farther left the piston will move thereby opening a larger number of paths for the return hydraulic fluid.

Associated with the transfer tray assembly 56 is an ammunition round identifier which includes two infrared optical switches. Each switch has a transmitter and a detector. The transmitters project a beam of pulsed infrared light through small holes in the side of the transfer tray structure. If the tray is empty, both detectors receive the beams. If the tray is loaded with one type of round one of the beams is blocked by the round. If the tray is loaded with the other type of ammunition round, both of the beams are blocked thereby identifying the round. The round identifier is not shown in the drawings. It is used during rearming operations to determine the ammunition round type being stowed and during normal firing sequence to verify selection of the correct ammunition type before the transfer tray assembly rotates from the vertical to the horizontal position.

Figure 7:
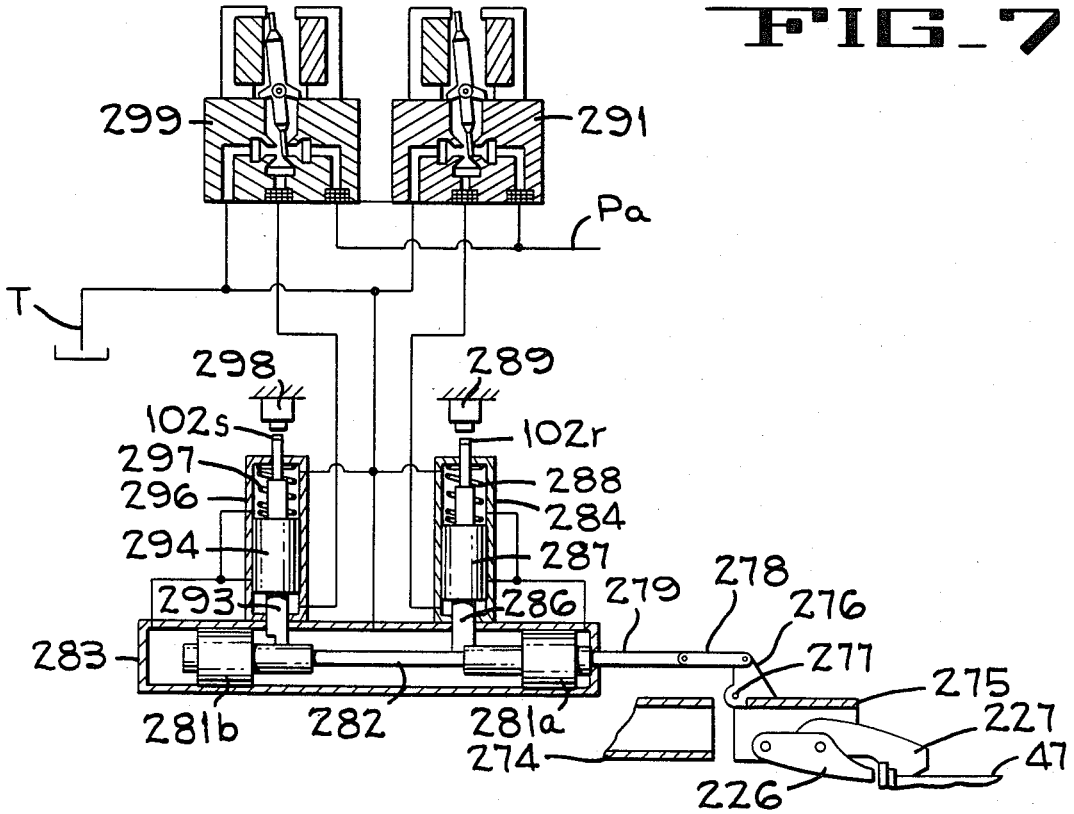
FIG. 7 is a hydraulic and mechanical schematic of a hoist pawl track shifter in one embodiment of the automatic loader system.

The manner in which the hoist pawl 227 and the ram pawl 226 are disengaged from the stub case of an ammunition round is best illustrated with reference to FIG. 7. The two pawls run in a fixed track 274, a portion of which is shown in FIG. 7. The roller chain 224 is guided within a chain track (not shown) which runs parallel to the pawl track. An end section 275 of the pawl track is attached to a lever 276 which is pivotable about a pivot point 277. Linkage 278 is attached between the lever and one end of a piston rod 279 extending from a piston 281*a* which has an opposite end 281*b* spaced therefrom by a stepped connecting member 282. The piston portions are configured to translate between the ends of a hydraulic cylinder 283. When the pistons translate to the left as seen in FIG. 7 the end section 275 of the pawl track pivots about the point 277 to thereby lift the ram and hoist pawls off of the flange on the stub case of an ammunition round 47 as shown.

The ram and hoist pawls 226 and 227 are latched in either the extended (aligned with the fixed pawl track 274) or the retracted (pivoted upwardly about point 277 as seen in FIG. 7) positions by means of latch actuating cylinders. An extended latch actuating cylinder 284 has a latch member 286 attached to a piston 287 therein which is urged into the latched position in engagement with the stepped member 282 by a compression coil spring 288. The pivoting track section 275 is thus latched in the aligned or extended condition as seen in FIG. 7. A proximity switch discr 102 is attached to an extension from the piston 287 and functions in conjunction with a proximity switch 289 to provide a signal indicative of extended latch and unlatch conditions.

When it is desired to shift the pivotable end section 275, a nozzle flapper valve 291 is actuated which opens a port on the right side within the valve body to introduce hydraulic pressure to the lower face of the piston 287 within the latch actuating cylinder 284. The piston is moved upwardly within the cylinder lifting the latch member 286 from the stepped connecting member 282 and pressure is communicated through the cylinder to the right side of the piston portion 281*a*. This piston is moved to the left within the cylinder 283, pulling on the linkage 278 and rotating the track section 275 about the pivot point 277 so that the ram and hoist pawls are released from the stub case flange. The pawls may therefore be withdrawn from an ammunition round within the gun breech after the round has been rammed into the breech, for example. The hoist pawl may further be retracted by the pawl track shifting mechanism to pick up or release a round in the ammunition drums 44 or preparatory to picking up a misfired ammunition round for extraction. For extraction of a misfired round during training or for off loading, the hoist and rammer drive is operated to present the round to the back of the transfer tray assembly 56 at the loading hatch. Upon a signal from personnel outside the hatch, the misfire latch pin 241 (FIG. 6) is commanded to a retracted position and the mechanism functions to pop the round part way out of the unloading hatch for removal. In a combat situation the drive operates to retract the misfire latch pin automatically as hereinbefore described and throws the misfired ammunition round out of the rear of the transfer tray.

The movement of the piston 281*a* to the left end of the cylinder 283 ultimately places the stepped member 282 in a position beneath a second latching member 293 so that the latching member may engage the step. This last mentioned latch member is attached to a piston 294 within a hydraulic actuating cylinder 296. The piston and the latching member 293 are urged downwardly into the latched position by the force of a coil compression spring 297 within the cylinder. A proximity switch disc 102*s* is attached to an extension from the piston 294 (FIG. 7) which is brought toward and away from a proximity switch 298 to thereby provide an indication that the pivotable track end section 275 is latched in the retracted or rotated position and the pawls are released from the ammunition round stub case flange.

When it is necessary to realign the pawl track section 275 with the fixed pawl track 274, a nozzle flapper valve 299 is actuated which thereby communicates pressure through a right side port within the valve body to the bottom face of the piston 294 in the cylinder 296. The hoist pawl retract latch member 293 is thereby lifted away from the stepped member 282 within the cylinder against the force exerted by the spring 297. Pressure is therefore communicated through the cylinder 296 to the left end of the cylinder 283. The pressure is exerted against the left face of the piston portion 281*b* thereby moving the unlatched piston to the right until it assumes the position seen in FIG. 7 and once again extends the pivotable pawl track end section 275 into alignment with the fixed track. As the stepped connecting member 282 passes beneath the end of the track extended latch 286 into the right stop, the latch is forced into the latching position as shown by the coil spring 288.

Figure 8:
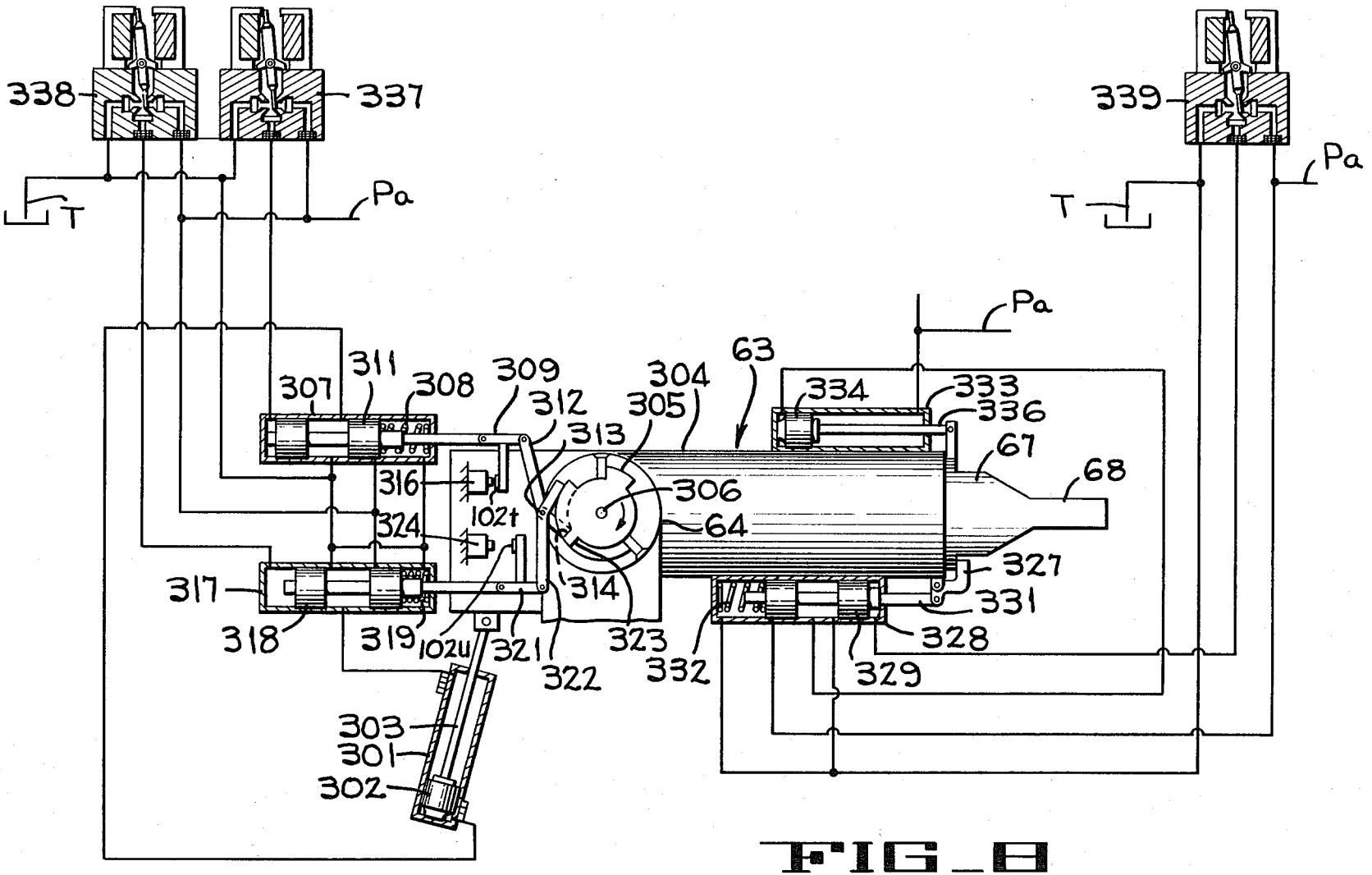
FIG. 8 is a hydraulic and mechanical schematic of the case eject tube assembly in one embodiment of the automatic loading system.
Figure 5:
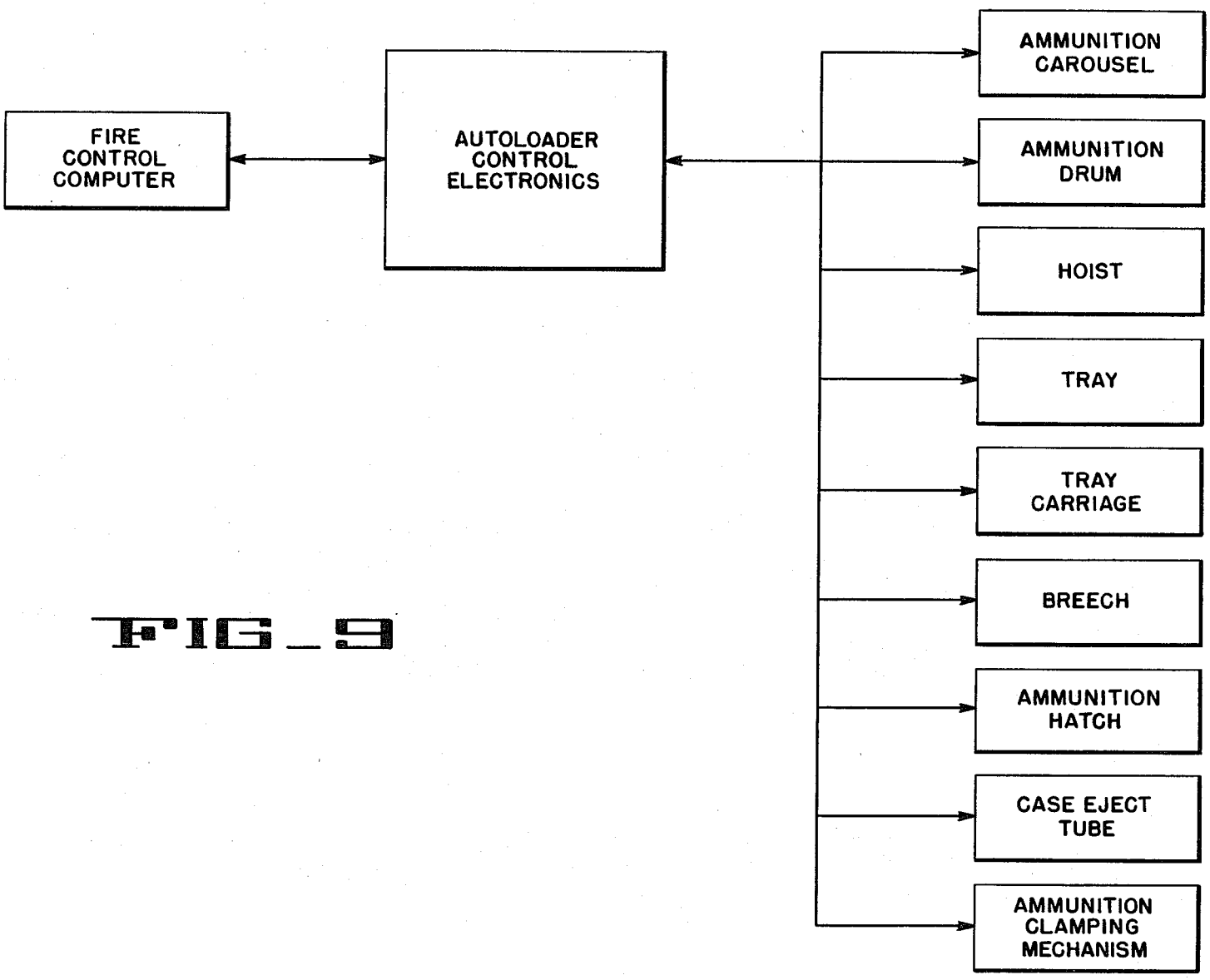

The case eject guide tube assembly 63 described in conjunction with FIGS. 1 and 2 is again mentioned with reference to FIG. 8. The case eject tube is mounted on the carriage 59 and is rotatable between a horizontal position wherein it may be positioned behind the gun breech to receive ammunition round stub cases ejected from the gun breech and guide them through the opening in the gun enclosure 29 when the loading hatch 31 is open and a position wherein the axis of the guide tube is substantially vertical as seen in dashed lines in FIG. 1. When the axis of the tube is substantially vertical it is in a stowed out-of-the-way condition so that it will not be contacted by the breech during recoil. A guide tube rotating cylinder 301 has a piston 302 therein from which a piston rod 303 extends. The end of the rod is attached to an outer guide tube shell 304 which is mounted on a pivot 306 within the boss 64 carried on the carriage 59. As can be seen in FIG. 8 if the rod is retracted the outer tube shell is pivoted around the pivot point 306 to the horizontal position and if it is extended it is pivoted so that the tube axis is substantially vertical.

A latching cam 305 is disposed about the pivot axis 306 for the guide tube assembly 63. A horizontal hydraulic latch cylinder 307 is spring loaded by a compression coil spring 308 to retract linkage 309 coupled to a piston 311 within the cylinder. The linkage rotates a bell crank member 312 about a pivot 313 to place one end of the latching member in a detent 314 in the latching cam. A proximity switch disc 102*t* is attached to the linkage 309 so that it is proximate to a proximity switch 316 when the guide tube is latched in the horizontal position, thereby providing a switch signal indicative of guide tube position.

A guide tube stowed latch cylinder 317 is shown containing a piston 318 which is urged toward the left end of the cylinder in FIG. 8 by a coil compression spring 319. Linkage 321 is attached to the piston at one end and to a latching bell crank 322 at the other end. The bell crank 322 is also pivoted about point 313 and rides on the latching cam 305 when the guide tube is rotated until it reaches the detent 323, whereupon the latch engages the detent and latches the guide tube in the stowed out-of-the-way condition. The linkage 321 carries another proximity switch disc 102*u* which is brought adjacent to a proximity switch 324 when the guide tube stowed latch is engaged to provide an indication that the guide tube is rotated into the stowed position.

The case eject guide tube assembly 63 includes the inner sleeve 67 which carries the nose section 68 extending therefrom to keep ejected stub cases from exiting through the right side of the breech block, as mentioned hereinbefore. An inner sleeve latch 327 is pivotally attached to the forward end of the outer sleeve 304. The latch engages the inner sleeve to prevent extension of the telescoping inner sleeve until the latch is released. A latch release hydraulic cylinder 328 has contained therein a piston 329 with a rod 331 extending therefrom which is coupled to the latch 327. A compression spring 332 is placed within the cylinder to urge the piston rod into an extended position to positively hold the latch 327 in engagement with the inner sleeve. Once the latch 327 has been released, the inner sleeve 67 may be extended into the stub case receiving position by providing hydraulic pressure to the left end of a hydraulic cylinder 333 as seen in FIG. 8. A piston 334 is contained within the cylinder having a rod 336 extending therefrom which is attached to the inner sleeve 67.

When the system requires that the case eject guide tube assembly 63 be rotated into the stowed out-of-the-way position with the guide tube axis substantially vertical, a nozzle flapper valve 337 is energized to unblock a right side port within the valve body and thereby introduce pressure to the left end of the piston 311 in the guide tube horizontal latch cylinder 307. The piston is moved to the right as seen in FIG. 8 to pivot the latch bell crank 312 about the point 313 and remove it from the step 314 shown in dashed lines on the latching cam 305. As the piston 311 moves to the right in the Figure pressure is introduced through the cylinder 307 to the lower end of the guide tube rotating cylinder 301. The unlatched guide tube assembly is rotated about the pivot 306 by extension of the rod 303 (through approximately 90°) and the latching bell crank 322 falls into the detent 323 to latch the guide tube assembly in the stowed condition. When it is desired to rotate the guide tube assembly back to the horizontal position in preparation for receiving empty stub cases ejected from the gun breech, another nozzle flapper valve 338 is actuated unblocking a right side port within the valve body and introducing pressure to the left end of the cylinder 317 to bear against the piston 318. Movement of the piston 318 to the right in FIG. 8 releases the stowed position latching bell crank 322 from the detent 323 and further introduces pressure through the cylinder 317 into the upper portion of the cylinder 301. The piston 302 is therefore urged back into the position in which it is shown in FIG. 8 and the unlatched guide tube assembly is rotated into the horizontal position. Yet another nozzle flapper valve 339 is actuated whereby pressure is introduced into the right end of the cylinder 328 forcing the piston 329 to the left therein and retracting the rod 331 to release the latch 327 on the inner sleeve of the telescoping guide tube assembly 63. With the inner sleeve unlatched and the piston 329 positioned to the left in the cylinder 328, pressure is directed through the cylinder 328 to the left end of the cylinder 333. There being a greater area on the left side of the piston 334 than on the right as seen in FIG. 8, the piston 334 is therefore urged toward the right against pressure Pa to extend the rod 336 and the inner sleeve 67 toward the breech opening in the cannon as best seen in FIG. 2.

When the nozzle flapper valve 339 is de-energized the spring 332 forces the piston 329 to the right in FIG. 8 and therefore moves the rod 331 into an extended position cutting off pressure to the left side of piston 334 and tending to rotate the inner sleeve latch 327 back into its latched position. However, with the inner sleeve 67 still extended the latch will only bear against the side of the sleeve until it is fully retracted and once again the latch may fall into the position shown in FIG. 8. Since pressure Pa is always communicated to the right end of the cylinder 333 and has been cut off from the left end, the rod 336 is retracted and the inner sleeve 67 is telescoped inside the outer sleeve 304. As previously mentioned, once the inner sleeve is in the fully telescoped position the latch member 327 is forced into place by the spring 332 and the empty case guide tube assembly 63 is once again in condition to be rotated into the stowed condition with the tube long axis substantially vertical.

Figure 10A:
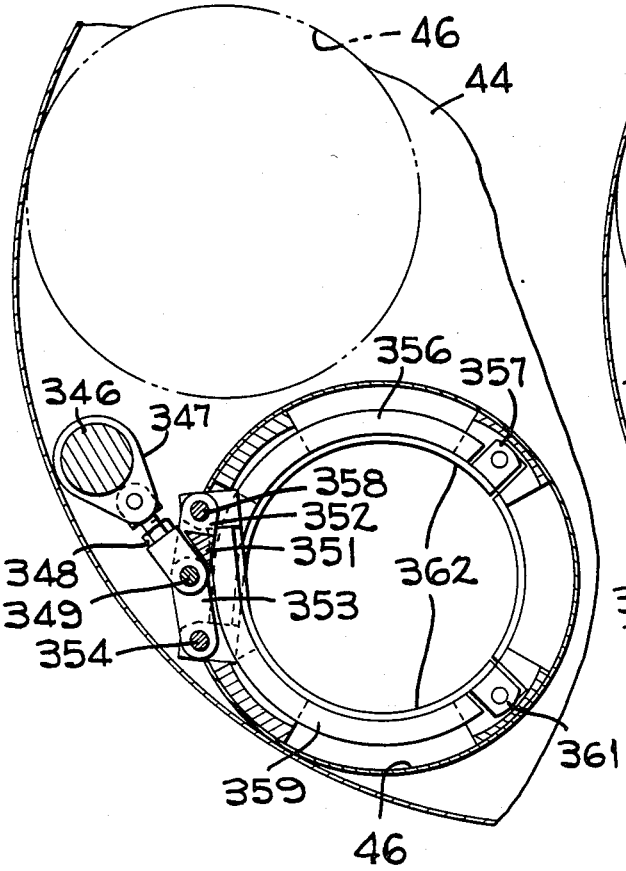
FIGS. 10A and 10B are views of ammunition round clamps used for storing ammunition rounds in a carousel of the automatic loading system.
Figure 10B:
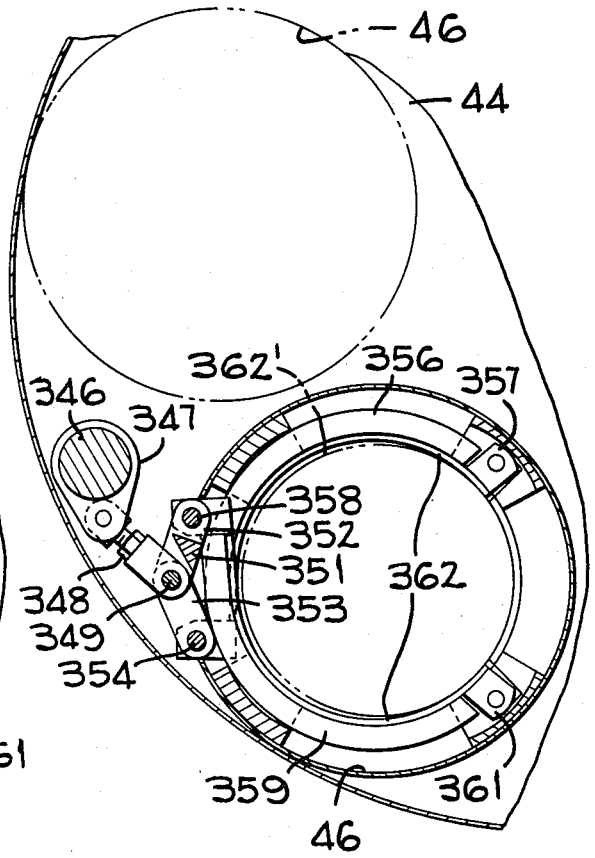

With reference now to FIGS. 10A and 10B a clamp will be described for the ammunition rounds 47 which are stowed in the storage cells 46. A part of an ammunition storage drum 44 is shown in each of the Figures and the ammunition clamp to be herein described is provided for each of the storage cells 46. The clamp engages the projectile end of the ammunition rounds which are stored base end up in the cells as hereinbefore described. A rod 346 for each cell runs down through the drum from the top thereof to the level of the projectile end clamps. The rod is turned in a counterclockwise direction as seen in FIGS. 10A and 10B to engage the round with the clamp and is turned in a clockwise direction to disengage the round. The rod has a collar 347 attached thereto which engages a pivoting link 348 which is adjustable in length. When a round is inserted into a cell the clamps are in the opened condition shown in FIG. 10B. When the clamp is to be engaged the rod 346 is turned counterclockwise and the pivotal connection between the collar and the link is repositioned in a counterclockwise direction relative to a line between the center of the rod and another pivot point 349 at the far end of the link 348. This provides an overcenter lock for the link 348 and it rests against a hard stop 351. A pair of additional links 352 and 353 are also pivoted at the pivot point 349. The free end of the additional link 353 is pivotally attached at 354 to a band 356 which is anchored to a block 357. In like fashion the free end of the additional link 352 is pivotally attached at 358 to one end of another band 359 which is anchored at a second block 361. Both of the bands 356 and 359 have a resilient layer 362 on the inside surface thereof for contacting the projectile ends of the ammunition rounds 47. As may be seen in FIG. 10B, when the rod 346 is turned out of the overcenter and locked condition of FIG. 10A in a clockwise direction, the links 352 and 353 assume more of an angular relationship to each other, thereby bringing the pivot points 354 and 358 closer together. The result is that the bands are moved from the position shown in dashed lines in FIG. 10B at 362' to the position shown in solid lines at 362. Thus the projectile end of the ammunition round is released for withdrawal of the round from the storage cell 46.

It should be noted that loading hatch 31 is properly sequenced to be opened for ejection of stub cases through the case eject guide tube assembly 63, is opened for removal of a misfired ammunition round as hereinbefore described, is opened for rearming or restocking of the magazine wherein ammunition rounds are entered into the system from the outside through the loading hatch, and is open for unloading ammunition rounds from the magazine by the transfer tray assembly 56 whereby rounds are emitted through the open hatch by the system in the unload mode. Actuation of the hydraulic cylinder 32 for the loading hatch is properly sequenced in the operation of the system and the open or closed condition of the hatch is monitored by proximity switches similar to those hereinbefore described.

The breech operating mechanism (not shown) is any one of several standard types which opens and closes the breech block for loading, firing, ejection of the empty stub cases and extraction of misfired ammunition rounds. During normal loading at zero elevation an ammunition round retainer is extended behind the stub case rim to capture the rim of the loaded round before the rammer pawl in the transfer tray releases the round. The retainer is a spring extended device which is pushed out of the way by the breech block when it closes. The retainer is retracted to keep it out of the way during stub case ejection. After the transfer tray is shifted out-of-the-way, the breech block is closed. During normal ejection of empty stub cases the breech operating piston opens the breech block rapidly to eject the empty stub case. In the event of a misfire however, the breech block is opened slowly so that the misfired ammunition round may be extracted without pulling the round apart.

It should be mentioned that the operating mechanism for the loading hatch 31 includes a hatch clear switch. The clear switch is a personnel safety device that interlocks the hatch closing operation. The switch is manually operated by personnel outside the gun enclosure 29 and is only functional during off loading, rearming of the magazine and slow speed misfire extraction of ammunition rounds. The operating piston within the actuator 32 for the loading hatch is powered to open and to close the hatch and the hatch is latched both opened and closed between operations.

The electrical control system of the disclosed autoloader operates to control the sequencing of the mechanical operations required to carry out the system functions. The control system receives mode and load orders from a fire control console and sends the autoloader status and ammunition inventory data to the fire control console for display. Appropriate signals are transmitted through the turret slip ring assembly shown generally at 42 (FIG. 1). The control system logic is microprocessor based. Upon receiving mode and load orders from the fire control computer, the control system automatically sequences the autoloader through the ordered operation. This is accomplished by controlling the hydraulics through solenoid operated valves (nozzle flapper valves as described herein) which are energized and de-energized by the control system logic. The inputs to the control system logic are derived from the proximity switches which have been described herein to provide indications of the position of all the components of the mechanism. Ammunition inventory is managed with the microprocessor. As each round is loaded into a storage cell 46, its location is stored in nonvolatile memory. The number of each type of ammunition round in the carousel type magazine 38 is shown on the operator's console. As seen in FIG. 9 a fire control computer is coupled to the autoloader control electronics which in turn receives the data relating to the positions of the ammunition carousel, ammunition drums on the carousel, the ammunition hoist, the transfer tray, the carriage, the gun breech, the ammunition hatch, the case eject guide tube and the ammunition clamping mechanism.

Figure 12:
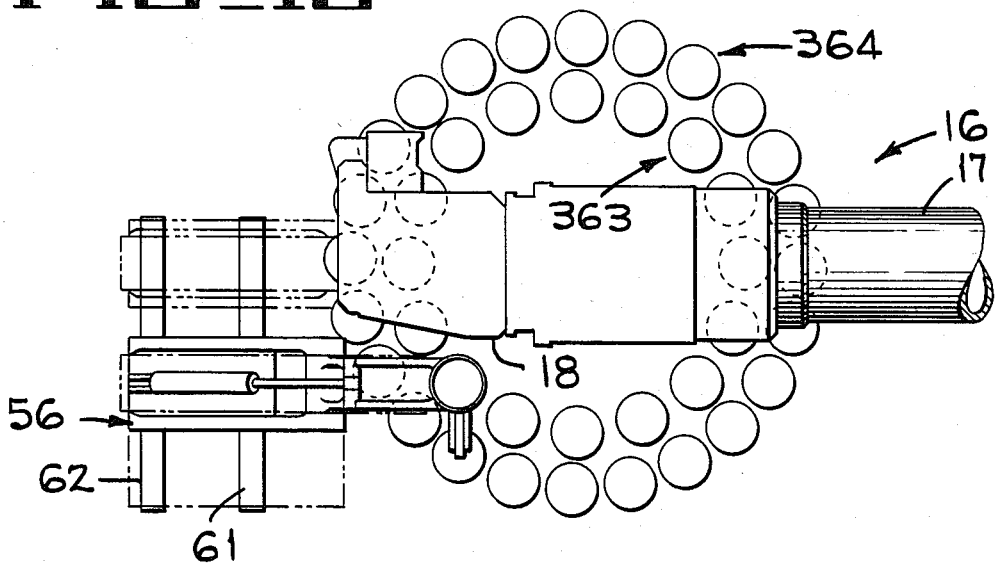
FIG. 12 is a top view of an alternate embodiment of the automatic loading system.

It should be noted that the carousel 38 described herein may have alternate configurations such as the one having an inner ring 363 and an outer ring 364 seen in FIG. 12. In such an instance the transfer tray assembly 56 is configured to be positioned at either the inner ring or the outer ring to load the storage cells in the carousel or to extract ammunition rounds from predetermined ones of the cells. Thus two transfer positions similar to that indicated as 46*a* are required.

Figure 11A:
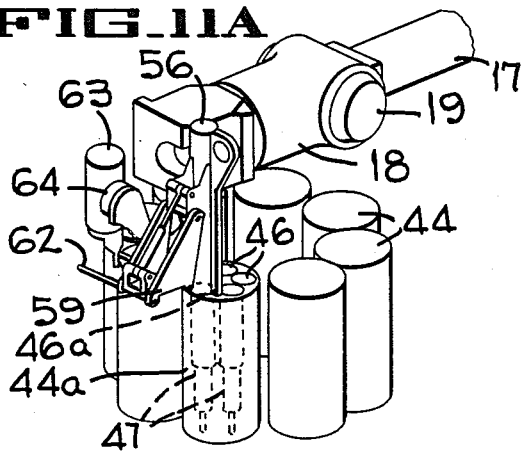
FIGS. 11A through 11H are perspective views of one embodiment of the automatic loading system showing portions of the operational sequence of the system of FIG. 1.
Figure 11B:
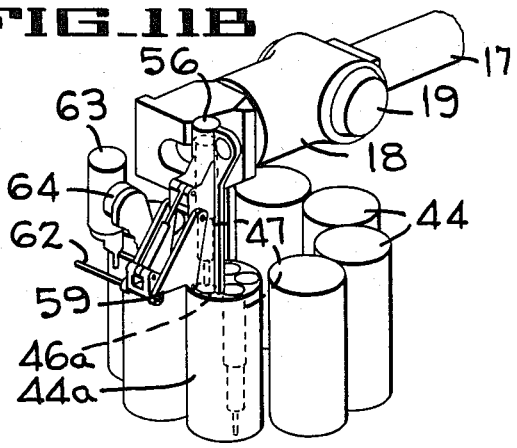
Figure 11C:
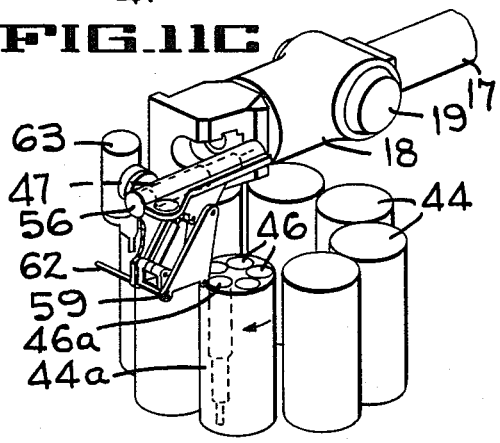
Figure 11D:
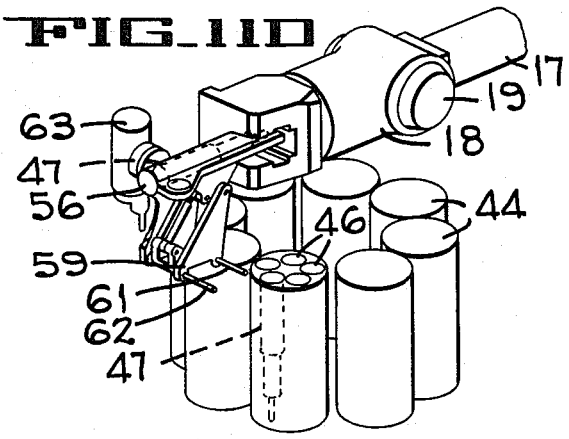
Figure 11E:
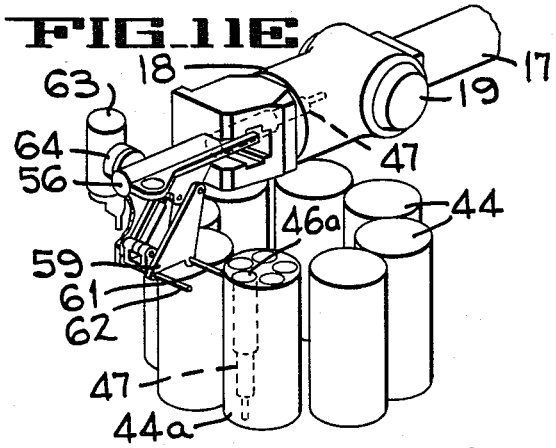
Figure 11F:
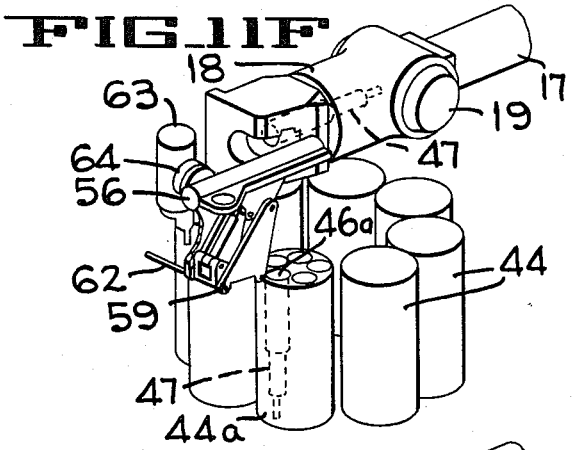
Figure 11G:
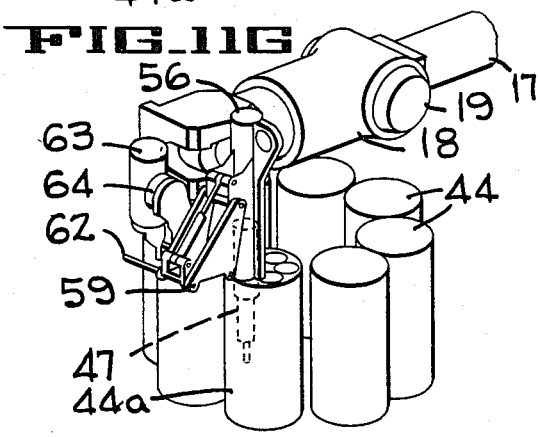
Figure 11H:
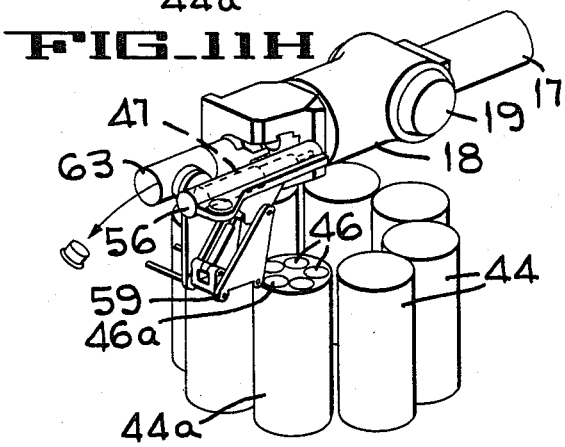

A general description of the sequencing of the autoloader will be undertaken with reference to FIGS. 11A through 11H. With the empty case guide tube 63 rotated into the stowed position as in FIG. 11A and the carriage moved laterally to the hoist position, the transfer tray assembly 56 is rotated on the carriage 59 so that the tray axis aligns with a preselected storage cell 46 in the transfer position 46*a*. The positioning blade 206 (FIG. 5) is placed in the appropriate alignment slot 204 and the rammer and hoist pawls are positioned toward the lower end of the tray. The ammunition clamps (FIGS. 10A and 10B) are released and the track shifting mechanism of FIG. 7 maneuvers the hoist pawl 227 behind the rim on the stub case of the ammunition round and the pawl is withdrawn upwardly in the transfer tray assembly to bring the round into the tray as seen in FIG. 11B. The tray assembly is then rotated into a horizontal position as seen in FIG. 11C and the carriage 59 is moved laterally on the tracks 61 and 62 to align the transfer tray axis with the breech axis when the cannon 17 is at zero elevation as seen in FIG. 11D. In the meanwhile the drum 44 at the drive position 44*a* is rotated to bring another round into the transfer position 46*a* as seen in FIG. 11C. The round is rammed into the gun breech by the rammer pawl 226 (FIG. 11E) and the carriage is once again translated back to the hoist position away from a position behind the breech (FIG. 11F). The breech block is closed and the gun is fired and recoils to a position close to the case eject guide tube assembly 63 in the stowed position (FIG. 11G). The guide tube is rotated to a position where its longitudinal axis is substantially horizontal and the inner sleeve 67 (FIG. 8) is extended as seen in FIG. 11H. In the meanwhile as seen in FIGS. 11G and 11H the next ammunition round to be fired has been engaged by the hoist pawl in the transfer tray assembly and drawn upwardly base first into the tray. The tray has been rotated to the horizontal position and after the stub case has been ejected through the empty case guide tube in alignment with the gun breech (FIG. 11H), the inner sleeve is telescoped back into the guide tube, latched, and the guide tube is rotated to the stowed position preparatory to translating the carriage 59 back to a position where the transfer tray is in alignment with the gun breech.

A more detailed description of the individual steps in the normal autoloader sequence for withdrawing ammunition rounds from the cells 46 and firing is set forth as follows:

1. Fire, return to battery and 0° elev.
2. Engage hoist pawl
3. Open ammunition clamps
4. Hoist round
5. Open ammunition hatch and latch
6. Rotate empty case tube horizontal and latch
7. Extend empty case tube
8. Open breech block and eject stub case
9. Retract empty case tube and latch
10. Close ammunition hatch and latch
11. Rotate empty case tube vertical and latch
12. Rotate transfer tray horizontal and latch
13. Shift carriage to breech and latch
14. Ram round
15. Latch round in breech
16. Release hoist pawl
17. Shift carriage to hoist position and latch
18. Close breech block
19. Synchronize, fire, return to battery and 0° elev.

The following operations take place concurrently with certain of the foregoing steps:

20. Close ammunition cell clamps
21. Index carousel one station and latch
22. Reset carousel drive piston
23. Index five cell drum one station
24. Reset index drum drive piston
25. Rotate transfer tray vertical and latch The manner in which the autoloader is rearmed or a new supply of ammunition rounds is deposited from outside the system through the loading hatch 31 and into recorded positions within the cells on the carousel is described as follows:

1. Rotate transfer tray horizontal and latch
2. Shift carriage to breech position and latch
3. Run hoist to normal back position
4. Open ammunition hatch and latch
5. Load round into tray and signal all clear
6. Close ammunition hatch and latch
7. Shift carriage to hoist position and latch
8. Rotate transfer tray vertical and latch
9. Open ammunition cell clamps
10. Lower round into cell with hoist
11. Close ammunition cell clamps
12. Disengage hoist pawl The details of the misfire sequencing in the automatic loading system disclosed herein are as follows: Initially the gun is at battery and zero degrees elevation with the misfire round in the gun tube and the breech block closed. The transfer tray assembly 56 is in the horizontal position with the carriage 59 at the hoist position. The carriage traverse hoist position latch 163 is engaged and the hoist chain 224 and pawl 227 are extended to the forward end of the transfer tray assembly. The ammunition hatch 31 is closed and latched.

1. Round retainer is unlatched and breech block is slowly fully opened.
2. The traverse latch 163 on the carriage 59 and the loading hatch latch are released.
3. The decelerate pawl (hoist pawl 227) is retracted (pivoting pawl track section 275 rotated).
4. The carriage 59 is shifted to align the tray 56 with the breech 18 and the loading hatch 31 is opened.
5. The traverse ram position latch 164 for the carriage is engaged.
6. The misfire latch pin 241 is retracted.
7. The hoist pawl is extended to engage the rim of the misfired ammunition round.
8. The hoist extracts the round from the breech and accelerates the round towards the open loading hatch.
9. The back half of the pawl (ram pawl 226) is cammed out-of-the-way.
10. The hoist pawl stops after an extended retraction of about $1\frac{1}{2}$ inches and the misfire ammunition round is thrown through the open loading hatch.

It should be noted that in addition to the three operating modes described hereinbefore, an off load mode to clear the carousel magazine of ammunition rounds is available which is substantially the reverse of the rearm mode. Also a round may be withdrawn from the breech and returned to the carousel magazine 38 in an operation substantially the reverse of the normal loading mode, without the empty case guide tube positioning steps of course. It should further be noted that in the automatic loading system described herein the gun elevation drive performs a dual function. The elevation drive not only positions the gun barrel on the target for firing but after firing returns the barrel to zero degrees elevation for empty case ejection and reload thus eliminating the complex transfer mechanism which is normally required to transfer ammunition between a stationary stowage position and a barrel moving in elevation.

Although the best mode contemplated for carrying out the present invention has been herein shown and described, it will be apparent that modification and variation may be made without departing from what is regarded to be the subject matter of the invention.

I claim:

1. An automatic loading system for moving large caliber fixed ammunition within a turret which is rotatable about an azimuth axis relative to a support structure and which has a gun barrel mounted there for movement in elevation relative thereto, comprising an ammunition storage ring disposed in the turret and rotatable about an axis substantially parallel to the azimuth axis, said storage ring including a carousel, and a plurality of rotating drums mounted on said carousel and each having a plurality of ammunition holding cells therein, whereby combined rotation of said carousel and said drums brings predetermined ones of said holding cells to a transfer position, means for indexing said storage ring to position predetermined ones of said holding cells at said transfer position, a transfer tray assembly mounted on the turret having means to receive, engage and discharge fixed ammunition rounds, means for moving said transfer tray assembly between said transfer position wherein an ammunition round may be moved between a holding cell and said tray and a predetermined elevation position aligned with the gun breech, whereby an ammunition round may be moved between said tray and the breech of the gun barrel when the barrel is at said predetermined elevation relative to the turret, means for moving ammunition rounds into and out of said transfer tray, means for receiving from the breech and discharging spent ammunition round cases, and means for controlling actuation of said means for indexing, means for moving said transfer tray, means for moving ammunition rounds, and means for receiving and discharging spent cases in appropriate sequence to operate the system in a selected mode.

2. An automatic loading system as in claim 1 wherein said means for receiving and discharging spent ammunition cases comprises a guide tube adapted to receive the spent cases, and means for rotating said guide tube between a discharge position aligned with the gun breech and an out-of-the-way position.

3. An automatic loading system as in claim 1 wherein said means for indexing comprises a carousel drive mounted on the turret, a drum drive mounted on the turret, and means for coupling said drum drive with the one of said rotating drums having holding cells rotatable into said transfer position.

4. An automatic loading system for moving large caliber fixed ammunition within a turret which is rotatable about an azimuth axis relative to a support structure and which has a gun barrel mounted therein for movement in elevation relative thereto, comprising an ammunition storage ring disposed in the turret and rotatable about an axis substantially parallel to the azimuth axis, said storage ring having a plurality of ammunition holding cells therein, said cells being adapted to accommodate and retain fixed ammunition rounds therein, means for indexing said storage ring to position predetermined ones of said holding cells at a transfer position, a transfer tray assembly mounted on the turret having means to receive, engage and discharge fixed ammunition rounds, means for moving said transfer tray assembly between said transfer position wherein an ammunition round may be moved between a holding cell and said tray and a predetermined elevation position aligned with the gun breech, whereby an ammunition roung may be moved between said tray and the breech of the gun barrel when the barrel is at said predetermined elevation relative to the turret, means for moving ammunition rounds into and out of said transfer tray, said last named means comprising a ram pawl, a hoist pawl pivotally attached to said ram pawl, and means for driving said ram and hoist pawls together in alternate directions along the length of said tray, so that rounds engaged by said ram and hoist pawls may be positioned within the gun breech by said ram pawl and removed from the breech and the holding cells by said hoist pawl, means for receiving and discharging spent ammunition round cases, and means for controlling actuation of said means for indexing, means for moving said transfer tray, means for moving ammunition rounds, and means for receiving and discharging spent cases in appropriate sequence to operate the system in a selected mode.

5. An automatic loading system for moving large caliber fixed ammunition within a turret which is rotatable about an azimuth axis relative to a support structure and which has a gun barrel mounted therein for movement in elevation relative thereto, comprising an ammunition storage ring disposed in the turret and rotatable about an axis substantially parallel to the azimuth axis, said storage ring having a plurality of ammunition holding cells therein, said cells being adapted to accommodate and retain fixed ammunition rounds therein, means for indexing said storage ring to position predetermined ones of said holding cells at a transfer position, a transfer tray assembly mounted on the turret having means to receive, engage and discharge fixed ammunition rounds, means for moving said transfer tray assembly between said transfer position wherein an ammunition round may be moved between a holding cell and said tray and a predetermined elevation position aligned with the gun breech, whereby an ammunition round may be moved between said tray and the breech of the gun barrel when the barrel is at said predetermined elevation relative to the turret, said means for moving said transfer tray assembly comprising a carriage track extending laterally on said turret structure, a carriage mounted on said carriage track, means for mounting said transfer tray for pivotal movement on said carriage, means for driving said transfer tray pivotally on said carriage, and means for driving said carriage laterally on said track, means for moving ammunition rounds into and out of said transfer tray, means for receiving and discharging spent ammunition round cases, and means for controlling actuation of said means for indexing, means for moving said transfer tray, means for moving ammunition rounds, and means for receiving and discharging spent cases in appropriate sequence to operate the system in a selected mode.

6. An automatic loading system for fixed ammunition for a large caliber gun movable about azimuth and elevation axes and carried in gun support structure, comprising a magazine disposed within the gun support structure and mounted for rotation relative thereto about a magazine axis substantially parallel to said azimuth axis, said magazine having a plurality of ammunition round storage cells therein, means for indexing said magazine rotationally about said magazine axis to bring predetermined ones of said storage cells into a transfer position, a carriage mounted for translational movement on the gun support structure, a transfer tray mounted for rotational movement on said carriage, means for urging ammunition rounds into and out of said transfer tray, said last named means comprising a ram pawl, a hoist pawl pivotally attached to said ram pawl, said ram and hoist pawls both having means to engage ammunition rounds, and means for driving said ram and hoist pawls together in alternate directions along said transfer tray length so that rounds may be positioned within the breech of the gun by said ram pawl and removed from the breech and the storage cells by said hoist pawl, means for moving said transfer tray between a position aligned with said transfer position and a predetermined elevation load/unload position aligned with the gun breech when the gun is at said predetermined load/unload elevation, means for receiving from the breech and for discharging spend ammunition cases, and means for controlling actuation of said means for indexing, means for urging, means for moving and means for receiving in appropriate sequence to operate the system in a selected mode.

7. An automatic loading system as in claim 6 wherein said means for indexing comprises a carousel drive mounted on the gun support structure, and means for sensing the rotational position of said carousel.

8. An automatic loading system as in claim 6 wherein said means for receiving and discharging spent ammunition cases comprises a guide tube adapted to receive the spent cases, and means for moving said guide tube between a discharge position aligned with the gun breech and an out-of-the-way position.

9. An automatic loading system as in claim 8 wherein said guide tube and said means for moving said guide tube are mounted on said carriage.

10. An automatic loading system as in claim 6 wherein said means for moving said transfer tray comprises a carriage drive disposed between the gun support structure and said carriage to provide carriage translational movement, and a transfer tray rotational drive disposed between said carriage and said transfer tray, said means for controlling operating to energize said drives in appropriate sequence to effect ammunition round movements in accordance with said selected operating mode.

11. An automatic loading system for fixed ammunition for a large caliber gun movable in elevation and carried in gun support structure, comprising a magazine disposed within the gun support structure and mounted for rotation relative thereto, said magazine having a plurality of ammunition round storage cells therein, and further including a carousel, a plurality of drums mounted on said carousel being movable rotationally relative thereto, said storage cells being within said drums and having axes substantially parallel to the axis of rotation of said carousel, means for indexing said magazine rotationally to bring predetermined ones of said storage cells into a transfer position, said means for indexing comprising a carousel drive and a drum drive operating in combination to bring said predetermined ones of said storage cells into said transfer position, a carriage mounted for translational movement on the gun support structure, a transfer tray mounted for rotational movement on said carriage, means for urging ammunition rounds into and out of said transfer tray, means for moving said transfer tray between a position aligned with said transfer position and a predetermined elevation load/unload position aligned with the gun breech when the gun is at said predetermined load/unload elevation, means for receiving from the breech and for discharging spend ammunition cases, and means for controlling actuation of said means for indexing, means for urging, means for moving and means for receiving in appropriate sequence to operate the system in a selected mode.

* * * * *